US006848179B2

(12) United States Patent
Takada

(10) Patent No.: US 6,848,179 B2
(45) Date of Patent: Feb. 1, 2005

(54) TERMINAL MOUNTING METHOD AND APPARATUS

(75) Inventor: Kazuhiko Takada, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/663,724

(22) Filed: Sep. 17, 2003

(65) Prior Publication Data

US 2004/0065464 A1 Apr. 8, 2004

Related U.S. Application Data

(62) Division of application No. 09/824,856, filed on Apr. 4, 2001, now Pat. No. 6,681,479.

(30) Foreign Application Priority Data

Apr. 18, 2000 (JP) ..... 2000-116462

(51) Int. Cl.[7] ..... H01R 43/04

(52) U.S. Cl. ..... 29/863; 29/857; 29/33 F; 29/748; 29/757

(58) Field of Search ..... 29/749, 759, 745, 29/747, 748, 757, 857, 861, 863, 876, 864, 33 M, 33 F

(56) References Cited

U.S. PATENT DOCUMENTS 4,363,167 A * 12/1982 Boutcher et al. ..... 29/863
4,476,628 A 10/1984 Kees, Jr.
4,660,279 A 4/1987 Szumierz et al.
4,870,747 A 10/1989 Maack et al.
4,945,627 A 8/1990 Brandeau
5,709,027 A 1/1998 Kato et al.
5,997,362 A * 12/1999 Hatagishi et al. ..... 439/701

FOREIGN PATENT DOCUMENTS

| | | |
|---|---|---|
| EP | 0 601 538 A2 | 6/1994 |
| EP | 0 855 767 A2 | 7/1998 |
| JP | 10-41041 | 2/1998 |
| JP | 10-154568 | 6/1998 |

* cited by examiner

*Primary Examiner*—Rick Kiltae Chang
(74) *Attorney, Agent, or Firm*—Armstrong, Krantz, Quintos, Hanson & Brooks, LLP

(57) ABSTRACT

A terminal mounting apparatus inserts press-fit terminals into a terminal housing for constituting a joint connector. The terminal mounting apparatus has a terminal positioning unit, a transfer unit, a carrier cutting unit, a tab bending unit, a separator, and an insertion unit. The terminal positioning unit adjusts spaces between adjacent ones of the terminals such that each of the terminals can enter one of the terminal insertion channels. The transfer unit transfers the terminals. The carrier cutting unit removes a desired joint portion jointing the terminals. The tab bending unit brings a desired contact tab, which can connect an upper one to a lower one of the terminals, into a connection state. The separator adjusts spaces between the terminals to correspond to spaces between terminal insertion channels. The insertion unit presses the terminals all at once into the terminal insertion channels.

4 Claims, 27 Drawing Sheets

TERMINAL MOUNTING METHOD AND APPARATUS

This application is a division of prior application Ser. No. 09/824,856 filed Apr. 4, 2001 now U.S. Pat. No. 6,681,479.

BACKGROUND OF THE INVENTION

1. Field of the Invention

The present invention relates to a terminal mounting method and a terminal mounting apparatus for mounting press-fit terminals in insulating housings which are layered to constitute an connector used for a wiring harness.

2. Related Art

A motor vehicle has a wiring harness for supplying a power to electrical appliances such as various lamps and motors from a battery. The wiring harness includes a plurality of electrical cables, a plurality of terminals each fitted to an end of each electrical cable, connector housings accommodating the terminals, etc. The connector housings and the terminals constitute connectors, and the wiring harness generally has a plurality of the connectors.

Recently, motor vehicles have an increasing number of on-vehicle electronic components, so that a plurality of sub-harnesses each having a specified function of the electronic components are provided. Thereafter, these sub-harnesses are combined with one another to complete the wiring harness. Therefore, the connection of the electrical cables across the sub-harnesses is complicated, decreasing the workability in the assembling of the wiring harness. This may cause an unreliable quality of the wiring harness.

To enable an easy connection of the electrical cables, it is proposed that insulating housings each having a plurality of press-fit terminals parallel disposed thereon are layered one another to obtain a connector. The insulating housing has a substantially rectangular plate main body and a plurality of terminal insertion channels. Each terminal insertion channel is concave on an upper surface of the plate main body to support the terminal.

Even when the insulating housings receiving the terminals are used, a known press-fitting unit as disclosed, for example, in Japanese Patent Application Laid-open No. H. 10-41041 or No. H. 10-154568 is preferably provided for press-fitting the terminal to the electrical cable.

Before the known press-fitting unit fits the terminal to the electrical cable, preferably, the insulating housing preliminarily receives the terminals. It is desired to mount the terminals in the insulating housing with a reduced expense in time and effort.

SUMMARY OF THE INVENTION

Thus, an object of the present invention is to provide a terminal mounting method and a terminal mounting apparatus which can reliably effectively mount a plurality of press-fit terminals on insulating housings layered to constitute a connector to obtain a wiring harness.

For achieving the object, a first aspect of the present invention is a method for mounting press-fit terminals in a plurality of terminal insertion channels parallel defined in an insulating housing. The method includes:

a first step for adjusting spaces between adjacent ones of the terminals such that each of the terminals can enter one of the terminal insertion channels, a second step for holding a required number of the terminals for the insulating housing, and a third step for inserting the terminals all at once into the plurality of terminal insertion channels.

Since the number of the terminals for one of the insulating housings are handled to be inserted into the terminal insertion channels of the insulating housing, the insulating housing can reliably receive the terminals before the layering of the insulating housings.

The number of the terminals are inserted all at once into the terminal insertion channels of the insulating housing, allowing a reduced time for effectively mounting the terminals in the insulating housing.

A second aspect of the present invention is a method depending on the first aspect, wherein the terminals are supplied as a jointed terminal assembly having the parallel press-fit terminals and joint portions jointing adjacent ones of the terminals to each other, and the method further includes a fourth step for removing at least one of the joint portions to isolate associated adjacent ones of the terminals from each other before the terminals are received in the insulating housing.

Therefore, the number of press-fit terminals for one of the insulating housings, which includes isolated ones and connected ones, are reliably inserted into the terminal insertion channels of the insulating housing. Thus, the terminals are effectively reliably inserted into the insulating housings which will be layered to compose a connector.

A third aspect of the present invention is a method depending on the first or second aspect, wherein the terminal has a connection portion that can move into a connection state and an isolation state, the connection state connecting the terminal to a second press-fit terminal disposed in a second insulating housing when the insulating housing having the terminal is layered on the second insulating housing, the isolation state isolating the terminal from the second press-fit terminal, and the method includes a fifth step for moving the connection portion to connect the terminal received in the insulating housing to the second press-fit terminal received in the second insulating housing and for keeping the connection portion to isolate the terminal received in the insulating housing from the second press-fit terminal when the insulating housings are layered.

Hence, the fifth step moves the connection portion in the connection state in which the connection portion connects to the second press-fit terminal mounted on the second insulating housing. Thus, the number of press-fit terminals for one of the insulating housings, which include isolated ones and connected ones for the terminals of the second insulating housing, are reliably inserted into the terminal insertion channels of the insulating housing.

Accordingly, the terminals are effectively reliably inserted into the insulating housings which will be layered to compose a connector.

A fourth aspect of the present invention is a method depending on any of the first to third aspects, wherein the insulating housing can receive the terminals in predetermined ones of the plurality of terminal insertion channels, and the method further includes a sixth step for adjusting spaces between the terminals held in the second step to coincide with spaces between the predetermined terminal insertion channels.

Hence, the sixth step adjusts the spaces between the terminals to coincide with the spaces between the terminal insertion channels receiving the terminals. Thus, the required number of the terminals for one of the insulating housings are inserted all at once into the terminal insertion channels of the insulating housing, even when the insulating housing has terminal insertion channels planed not to receive the terminals.

This reduces a production cost of a connector constituted by layering insulating housings.

A fifth aspect of the present invention is a method for mounting press-fit terminals in a plurality of terminal insertion channels parallel defined in an insulating housing, wherein the terminals are supplied as a jointed terminal assembly having the parallel press-fit terminals and joint portions jointing adjacent ones of the terminals to each other, and the terminal has a connection portion that can move into a connection state and an isolation state, the connection state connecting the terminal to a second press-fit terminal received in a second insulating housing when the insulating housing having the terminal is layered on the second insulating housing, the isolation state isolating the terminal from the second press-fit, the insulating housing being able to receive the terminals in predetermined ones of the plurality of terminal insertion channels.

The method includes:

a step S1 for adjusting spaces between adjacent ones of the terminals such that each of the terminals can enter one of the terminal insertion channels, a step S2 for holding a required number of the terminals for the insulating housing, and a step S3 for removing at least one of the joint portions to isolate associated adjacent ones of the terminals from each other after the terminals has been received in the insulating housing, a step S5 for moving a connection portion to a connection state and an isolation state, the connection state connecting the terminal to a second press-fit terminal received in a second insulating housing when the insulating housing having the terminal is layered on the second insulating housing, the isolation state isolating the terminal from the second press-fit terminal, a step S7 for adjusting spaces between the terminals held in the second step to coincide with spaces between the predetermined terminal insertion channels, and a step S8 for inserting the terminals all at once into the terminal insertion channels.

Hence, the number of the terminals required for one of the insulating housings are handled at once. The joint portion is removed to isolate the terminals. The connection portion is moved into the connection state with the terminal of the second insulating housing. The spaces between the terminals are adjusted to coincide with the spaces between the terminal insertion channels receiving the terminals. The terminals for one of the insulating housings are inserted all at once into the terminal insertion channels of the insulating housing. Thus, the terminals are reliably inserted into the terminal insertion channel of the insulating housing according to a predetermined pattern.

A sixth aspect of the present invention is an apparatus for mounting press-fit terminals in a plurality of terminal insertion channels parallel defined in an insulating housing, wherein the terminals are supplied as a jointed terminal assembly having the parallel press-fit terminals and joint portions jointing adjacent ones of the terminals to each other.

The apparatus includes:

a terminal space adjusting means for adjusting spaces between adjacent ones of the terminals such that each of the terminals can enter one of the terminal insertion channels, a terminal holding means for holding a required number of the terminals having the spaces adjusted by the terminal space adjusting means for mounting the terminals in the insulating housing, and a terminal insertion means for inserting the terminals all at once into the plurality of terminal insertion channels of the insulating housing.

Since the number of the terminals required for one of the insulating housings are handled at once to be inserted into the terminal insertion channels of the insulating housing, the insulating housing can reliably effectively receive the terminals before the layering of the insulating housings.

Furthermore, the number of the terminals are inserted all at once into the terminal insertion channels of the insulating housing, allowing a reduced time for mounting the terminals in the insulating housing. In addition, the adjustment of the spaces between the terminals enables to surely handle the number of the terminals of the insulating housing.

A seventh aspect of the present invention is an apparatus depending on the sixth aspect, which further includes a joint portion removing means for removing at least one of the joint portions to isolate associated adjacent ones of the terminals held by the terminal holding means from each other.

Hence, the joint portion is removed to isolate the terminals. The number of press-fit terminals for one of the insulating housings, which includes isolated ones and connected ones, are reliably inserted into the terminal insertion channels of the insulating housing.

Thus, the terminals are effectively reliably inserted into the insulating housings which will be layered to compose a connector.

An eighth aspect of the present invention is an apparatus depending on the six or seventh aspect, wherein the terminal has a connection portion moving into a connection state and an isolation state, the connection state connecting the terminal to a second press-fit terminal received in a second insulating housing when the insulating housing having the terminal is layered on the second insulating housing, the isolation state isolating the terminal from the second press-fit terminal, and the apparatus has a connection portion moving means for moving the connection portion into the connection state connecting the terminal to the second press-fit terminal.

Hence, the connection portion is moved into the connection state in which the connection portion connects to the second press-fit terminal mounted on the second insulating housing.

Thus, the required number of press-fit terminals for one of the insulating housings are reliably inserted into the terminal insertion channels of the insulating housing. Some of the terminals are isolated from the terminals of the second insulating housing, while the others are in a connection state with the terminals of the second insulating housing. Thus, the terminals are effectively reliably inserted into the insulating housings which will be layered to compose a connector.

A ninth aspect of the present invention is an apparatus depending on any of the sixth to eighth aspects, wherein the insulating housing can receive the terminals in predetermined ones of the plurality of terminal insertion channels, and the method further includes a second terminal space adjusting means for further adjusting the spaces of the terminals held by the terminal holding means to coincide with spaces between the predetermined terminal insertion channels.

Hence, the spaces between the terminals are adjusted to coincide with the spaces between the terminal insertion channels receiving the press-fit terminals. Thus, the required number of the terminals for one of the insulating housings are inserted all at once into the terminal insertion channels of the insulating housing, even when the insulating housing has terminal insertion channels that will not receive the terminals. This reduces a production cost of a connector constituted by layering the insulating housings.

A tenth aspect of the present invention is an apparatus for mounting press-fit terminals in a plurality of terminal insertion channels parallel defined in an insulating housing, wherein the terminals are supplied as a jointed terminal assembly having the parallel press-fit terminals and joint portions jointing adjacent ones of the terminals to each other, and the terminal has a connection portion moving into a connection state and an isolation state, the connection state connecting the terminal to a second press-fit terminal received in a second insulating housing when the insulating housing having the terminal is layered on the second insulating housing, the isolation state isolating the terminal from the second press-fit terminal, the insulating housing being able to receive the terminals in predetermined ones of the plurality of terminal insertion channels.

The apparatus includes:

a terminal space adjusting means for adjusting spaces between the terminals such that each of the terminals can enter one of the terminal insertion channels, a terminal holding means for holding a required number of the terminals having the spaces adjusted by the terminal space adjusting means for mounting the terminals in the insulating housing, a joint portion removing means for removing at least one of the joint portions to isolate associated adjacent ones of the terminals held by the terminal holding means from each other, a connection portion moving means for moving the connection portion into the connection state connecting the terminal to the second press-fit terminal, a second terminal space adjusting means for further adjusting the spaces of the terminals held by the terminal holding means to coincide with spaces between of the predetermined terminal insertion channels, and a terminal insertion means for inserting the terminals adjusted in the spaces by the second terminal space adjusting means all at once into the plurality of terminal insertion channels of the insulating housing, wherein the terminal holding means transfers the terminals adjusted in the spaces by the terminal space adjusting means sequentially across the joint portion removing means, the connection portion moving means, the second terminal space adjusting means, and the terminal insertion means.

Hence, the terminal holding means transfers the terminal across the joint portion removing means, the connection portion moving means, the second terminal space adjusting means, and the terminal insertion means. Thus, the terminals are reliably inserted into the terminal insertion channels of the insulating housing, and a reduced time for mounting the terminals in the insulating housing is achieved.

An eleventh aspect of the present invention is an apparatus depending on any of the sixth to tenth aspect, wherein the terminal has a pair of electrical contact portions and a cable connection portion for connecting an electrical cable, the electrical contact portions having walls spaced from each other, and the terminal space adjusting means has a plurality of parallel adjustment bars disposed in a row direction of the terminals, a plurality of tabs provided on each of the adjustment bars disposed in the row direction, and an alignment member having a plurality of parallel peaks and valleys facing to ends of the terminals, the adjustment bars being arranged such that a tab of each of the adjustment bars is equally spaced from an adjacent tab of another of the adjustment bars, the adjustment bars being movable close to and apart from the cable connection portions, the alignment member being disposed so as to be movable close to and apart from the electrical contact portion, the adjustment bars being able to pinch the cable connection portions between the tabs when the adjustment bars come close to the terminal, each peak of the alignment member being inserted into a pair of walls of the electrical contact portion when the alignment member comes close to the terminals so as to adjust spaces between the terminals.

Hence, the terminal space adjusting means pinches the electrical contact portion of the terminal between the tabs of the adjustment bars, while the peak of the alignment member enters between the side walls of the terminal. Thus, the spaces between the terminals are surely adjusted for one of the associated insulating housing, and the terminals are surely handled to be inserted all at once into the terminal insertion channels of the insulating housing. Therefore, the terminals are effectively reliably inserted into the insulating housings which will be layered to compose a connector.

A twelfth aspect of the present invention is an apparatus depending on any of the sixth to tenth aspects, wherein the adjustment bars are moved toward the terminals sequentially downstream in a terminal transfer direction.

Hence, the adjustment bars are arranged in the feed direction of the jointed terminal assembly to come toward the terminals. Thus, the tabs of the adjustment bars pinch the cable connection portions of the terminals sequentially from the most downstream one. Thus, the spaces between the terminals are surely adjusted.

A thirteenth aspect of the present invention is an apparatus depending on any of the sixth to twelfth aspects, wherein the terminal holding means has a holder movable close to and apart from the terminals, the holder having a plurality of second tabs disposed parallel to the longitudinal directions of the terminals, so that the holder holds the terminals with the cable connection portions being pinched between the second tabs when the holder comes close to the terminals.

Hence, the second tabs of the holder pinch the terminal so that the terminal holding means surely holds the terminal.

A fourteenth aspect of the present invention is an apparatus depending on any of the seventh to tenth aspects, wherein the joint portion removing means has a plurality of cutting dies for pinching the joint portions therebetween to cut the joint portions from the terminals.

Hence, the cutting dies pinch a desired joint portion therebetween to surely cut away it from the terminal.

A fifteenth aspect of the present invention is an apparatus depending on any of the eighth to tenth aspects, wherein the terminal has a cable connection portion for connecting the electrical contact portion to the electrical cable and a connection wall for connecting the electrical contact portion to the cable connection portion, the connection portion having an elongated plate-shaped end contiguous with the electrical contact portion, the elongated plate-shaped end being parallel to the connection wall when the connection portion is in an insulating state, the elongated plate-shaped end being extended in a direction crossing the connection wall when the connection portion is in a connection state.

The connection portion moving means has:

a first die movable toward the electrical contact portion along the connection wall from an end position of the terminal which is in a side of the cable connection portion, and a second die movable along the connection wall toward the electrical contact portion from an end position in the side of the cable connection portion of the terminal, the first die having an inclined surface contacting the connection portion when the first die moves toward the electrical contact portion, the inclined surface gradually increasing a contact area with the connection wall when the first die comes close to the electrical contact portion, the second die having a forming surface contacting the connection portion when the second die moves toward the electrical contact portion, the forming surface being disposed along the connection portion during the connection state.

Hence, the first die has the inclined surface that gradually comes close to the connection wall of the terminal, and the second die has the forming surface to face the connection portion of the terminal which is a connection state. Thus, the connection portion can be reliably moved from the isolated state into the connection state.

A sixteenth aspect of the present invention is an apparatus depending on any of the ninth or tenth aspect, wherein at least one of the terminal insertion channels of the insulating housing does not receive the terminal, and the holder is movable parallel to the longitudinal directions of the terminals and can be movable close to and apart from the terminal in a direction crossing the longitudinal directions, the second terminal space adjusting means having a plurality of extendable members movable close to and apart from the terminal and positioning the terminals, the extendable member positioning the terminals which are located in an upstream or downstream side of the most upstream or downstream position corresponding to a terminal insertion channel planed to receive none of the terminals, the holder transferring downstream or upstream the terminals which are located in the downstream or upstream side of the position corresponding to the terminal insertion channel planed to receive none of the terminals until the terminals are positioned to correspond to the terminal insertion channels, the extendable member positioning the terminals that have been transferred to locations opposed to the terminal insertion channels.

Hence, the extendable member correctly positions the terminals which have been substantially opposed to the corresponding terminal insertion channels. Meanwhile, the terminal holding means handles the terminals which have not been oriented to the corresponding terminal insertion channels to move them to correspond the correct terminal insertion channels. Then, the extendable member correctly positions the transferred terminals. Thus, the spaces between the required number of the terminals for one of the insulating housings are adjusted to be inserted into the corresponding terminal insertion channels. Therefore, the terminals are effectively reliably inserted into the insulating housings which will be layered to compose a connector.

A seventeenth aspect of the present invention is an apparatus depending on any of the sixth to sixteenth aspects, wherein the terminal has a connection wall laying the electrical cable thereon, side walls contiguous with the connection wall, and a cutout defined in each of the side walls.

The terminal insertion means has an insertion member and a moving means for moving the insertion member toward the insulating housing, the insertion member movable close to and apart from the terminal, the insertion member having a projection that enters the cutout when the insertion member comes close to the terminal.

Hence, the projection of the insertion member enters the cutout, and the moving means moves the insertion member toward the insulating housing. Thus, the terminal insertion means can surely insert the required number of the terminals for one of the insulating housings into the corresponding terminal insertion channels. Therefore, the terminals are effectively reliably inserted into the insulating housings which will be layered to compose a connector.

DETAILED DESCRIPTION OF THE PREFERRED EMBODIMENT

Figure 27:
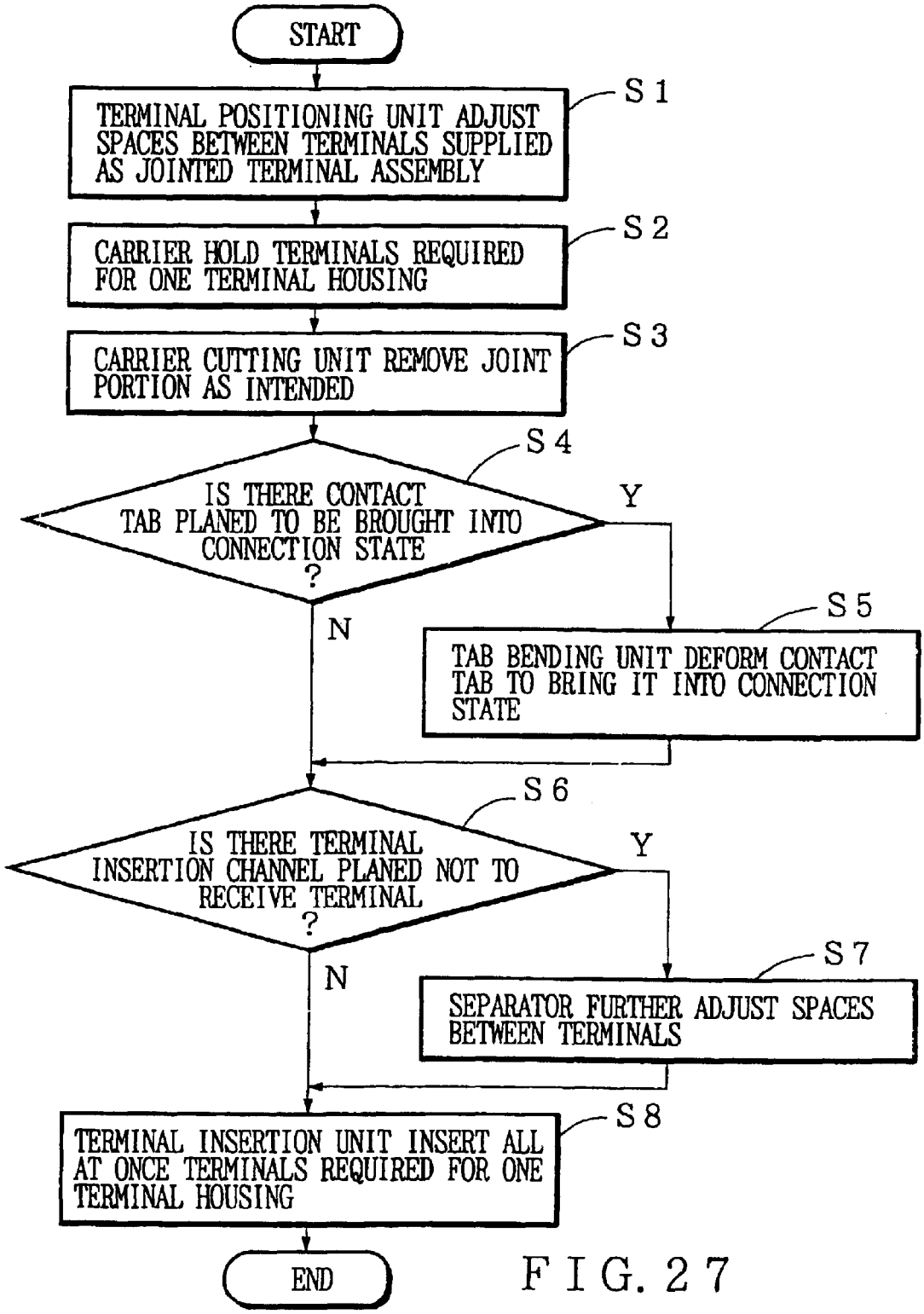
FIG. 27 is a flowchart showing steps in which the terminal mounting apparatus of FIG. 1 mounts the terminals in the terminal housing.
Figure 28:
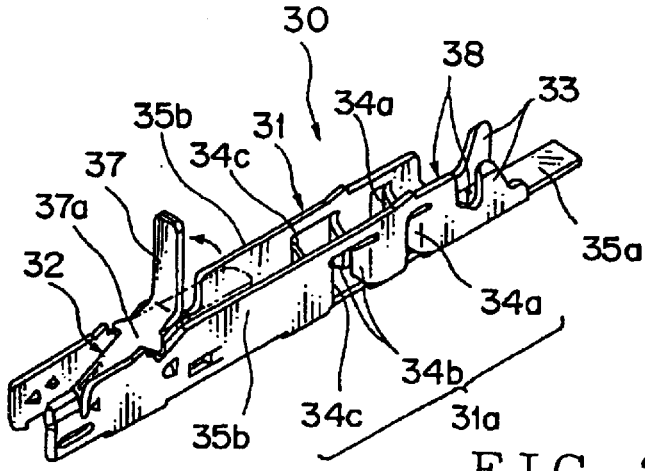
FIG. 28 is a perspective view of the terminal mounted by the terminal mounting apparatus of the embodiment.

Referring to FIGS. 1 to 27, a terminal mounting apparatus 1 according to an embodiment of the present invention will be discussed herein after. As best shown in FIG. 3, the terminal mounting apparatus 1 mounts press-fit terminals 30 in a terminal housing 40 constituting an insulating housing. The terminal 30 best shown in FIG. 28 is used to a joint connector.

Figure 29:
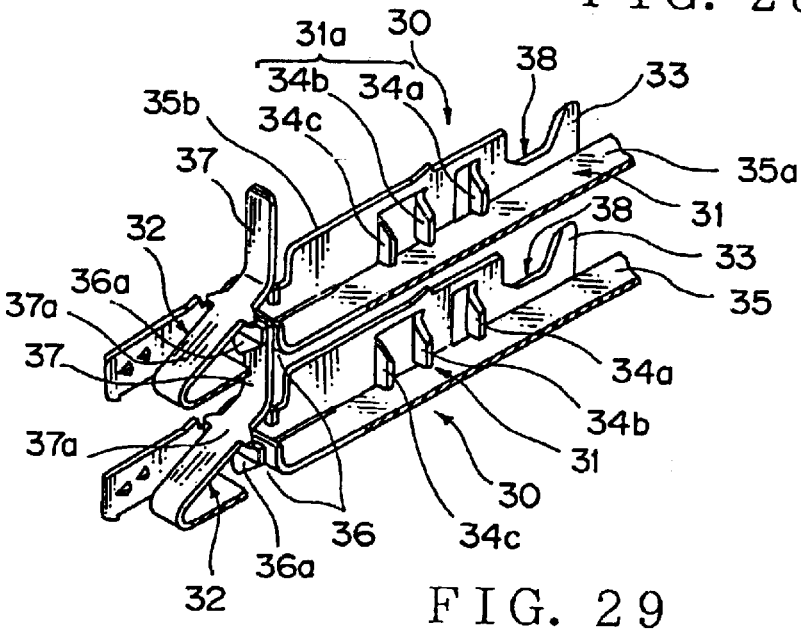
FIG. 29 is an explanatory view showing a state in which two of the terminals of FIG. 28 are layered to be electrically connected to each other.

The terminal 30 is defined by bending an electrically conductive metal plate. As illustrated in FIGS. 28 and 29, the terminal 30 has a flat connection wall 35*a* laying an electrical cable 4 (see FIG. 34) thereon, a pair of side walls 35*b*, a cable connection portion 31, and an electrical contact portion 32. The connection wall 35*a* corresponds to the connection wall described in the summery of the invention.

The connection wall 35 and side walls 35*b* each are shaped in a band plate. Each side wall 35*b* is contiguous with and raised from each side edge of the connection wall 35*a*.

The electrical cable connection portion 31 has a pair of opposed crimping pieces 33, a press-fit portion 31*a*, and a pair of cutouts 38. The crimping pieces 33 are vertically extended relative to the bottom wall 35. The crimping pieces 33 are bent to hold the electrical cable 4 (see FIG. 34) disposed on the connection wall 35*a*. The crimping piece 33 corresponds to the crimping piece described in the summery of the invention.

The press-fit portion 31*a* has three pairs of opposed press fitting blades 34*a*, 34*b*, and 34*c*. The press fitting blades 34*a*, 34*b*, and 34*c* are vertically extended relative to the connection wall 35*a*. Each press-in blade 34*a*, 34*b*, or 34*c* projects inside from the side wall 35*b*.

The press fitting blades 34*a*, 34*b*, and 34*c* receive the electrical cable 4 which is inserted between each pair of the blades. Thereby, the blades cut into an insulation sheath of the electrical cable 4 to contact a wire core to electrically connect to the electrical cable 4. That is, the press-fitting of the blades for the electrical cable 4 is completed.

Each cutout 38 is defined by partially cutting away each side wall 35*b*. The cutout 38 has a concave peripheral edge facing outwardly. The cutout 38 is located between the crimping piece 33 and the press-fit portion 31*a*.

The electrical contact portion 32 has an opening 36 (see FIG. 29) provided in the connection wall 35*a* and has a contact tab 37 raised from the connection wall 35*a* and serving as a connection means. The contact tab 37 is shaped in a plate, one end of which is contiguous with the connection wall 35*a* and the electrical contact portion 32.

The contact tab 37 is changeable from a vertical position to a parallel position relative to the connection wall 35*a* by a bending work. The parallel position is illustrated by a chain line in FIG. 28. Note that the contact tab 37 permanently maintains the vertical position or the parallel position relative to the connection wall 35*a* once the position is set.

Note that the vertical position of the contact tab 37 relative to the connection wall 35*a* corresponds to the connection state described in the invention summary, while the parallel position corresponds to the isolated state described in the invention summary. The contact tab 37 keeps the isolated state when the terminals 30 are configured as a jointed terminal assembly 20 (see FIG. 3 or FIG. 19).

As illustrated in FIG. 29, the opening 36 has a resilient contact piece 36*a* for press-fitting the contact tab 37 to an end of the connection wall 35*a*.

The terminals 30 for a joint connector are layered with a space therebetween in parallel to the bottom wall 35*a*. The electrical contact piece 32 electrically connects the terminals 30 to one another, since the contact tab 37 of the terminal 30 is inserted into the opening 36 of another upper press-fit terminal 30*a* as illustrated in FIG. 29.

At the same time, the contact tab 37 of the lower press-fit terminal 30 is pinched between an end part of the bottom wall 35 and the resilient contact piece 36*a* of the upper press-fit terminal 30.

Figure 32:
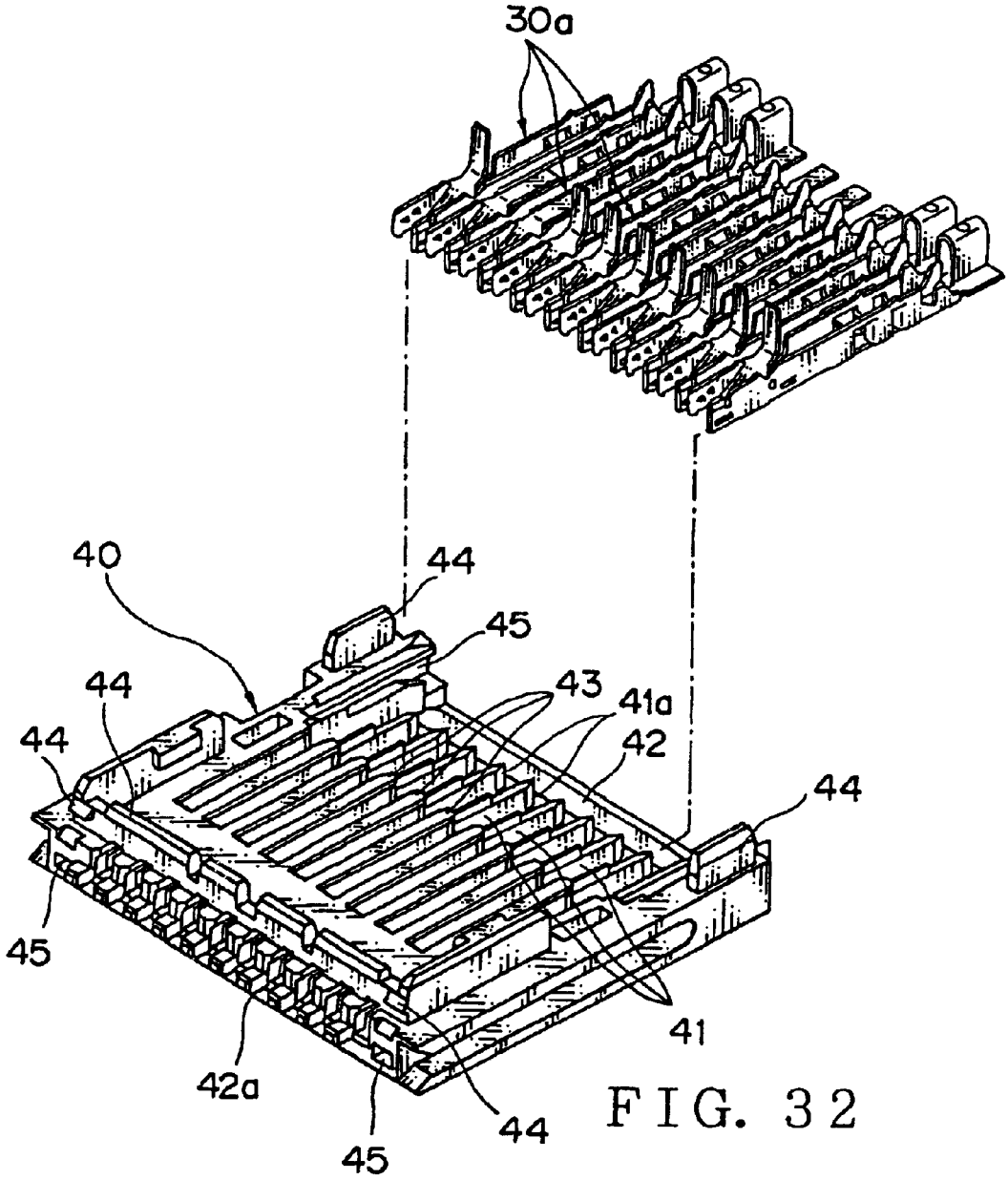
FIG. 32 is a perspective view showing a state in which the terminals are pressed into the terminal housing of FIG. 31.

As illustrated in FIG. 32, the terminals 30 is forced into a terminal accommodation chamber 41 of a terminal housing 40*a*, for example, by the terminal mounting apparatus 1. Thereby, the terminal 30*a* is received in the terminal housing 40*a* to be secured therein.

When forced into the terminal accommodation chambers 41 by the terminal mounting apparatus, the terminals 30 are provided as the jointed terminal assembly 20. That is, the connection wall 35*a* of the terminals 30 are disposed in parallel to one another, while ends of the terminals 30, each of which is located in the side of the cable connection portion 31, are connected to each other by the connection portion 39.

Figure 30:
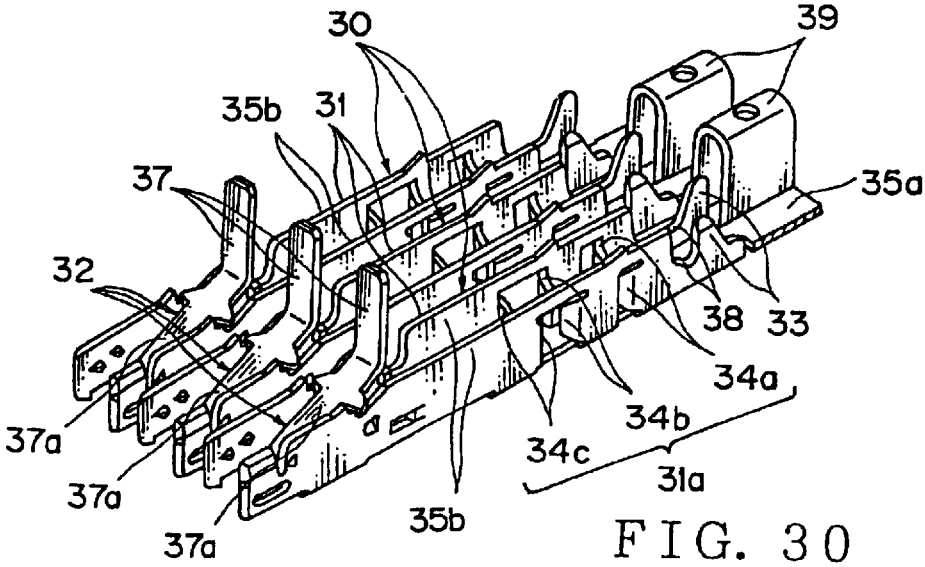
FIG. 30 is an explanatory view showing a state in which a plurality of the terminals of FIG. 28 parallel disposed to be electrically connected to one another.
Figure 31:
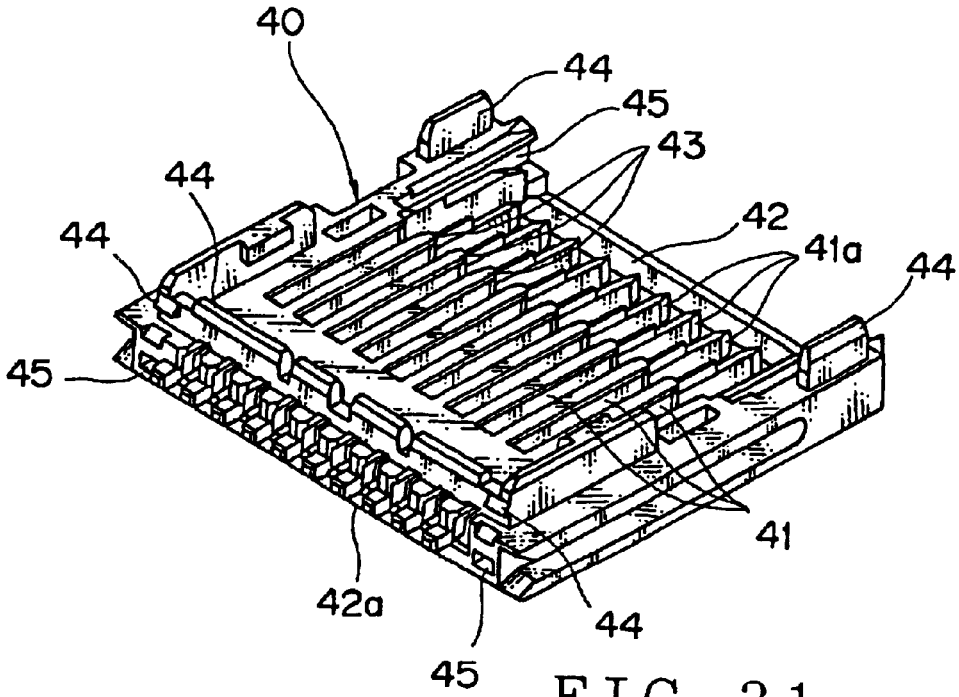
FIG. 31 is a perspective view showing a terminal housing to insert the terminals of FIG. 28.

To electrically connect adjacent ones of the terminals 30, the connection piece 39 is kept as illustrated in FIG. 30. Meanwhile, to isolate the terminals 30, the connection piece 39 is removed from the connection wall 35*a*.

The terminal housing 40 is made of an insulating synthetic resin material or the like. As illustrated in FIGS. 31 to 36, the terminal housing 40 has a rectangular plate-like main body 42, a plurality of partitions 43 raised from the main body 42, and a plurality of terminal accommodation chambers 41. The partitions 43 are parallel to one another and define the terminal accommodation chambers 41 between them.

Figure 33:
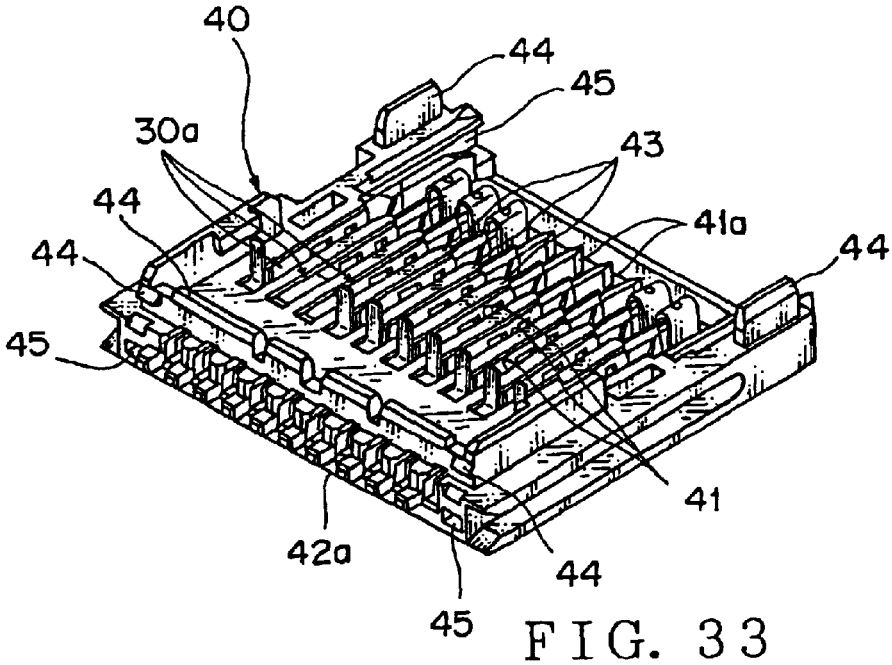
FIG. 33 is a perspective view showing a state in which the terminals are mounted in the terminal housing of FIG. 31.

As illustrated in FIG. 33, the terminal housing 40 receives the terminals 30 in the terminal receiving channels 41. At that time, as illustrated in FIG. 32, the terminal 30 is inserted from one end 41*a* of the terminal insertion channel 41 of the terminal housing 40.

Figure 36:
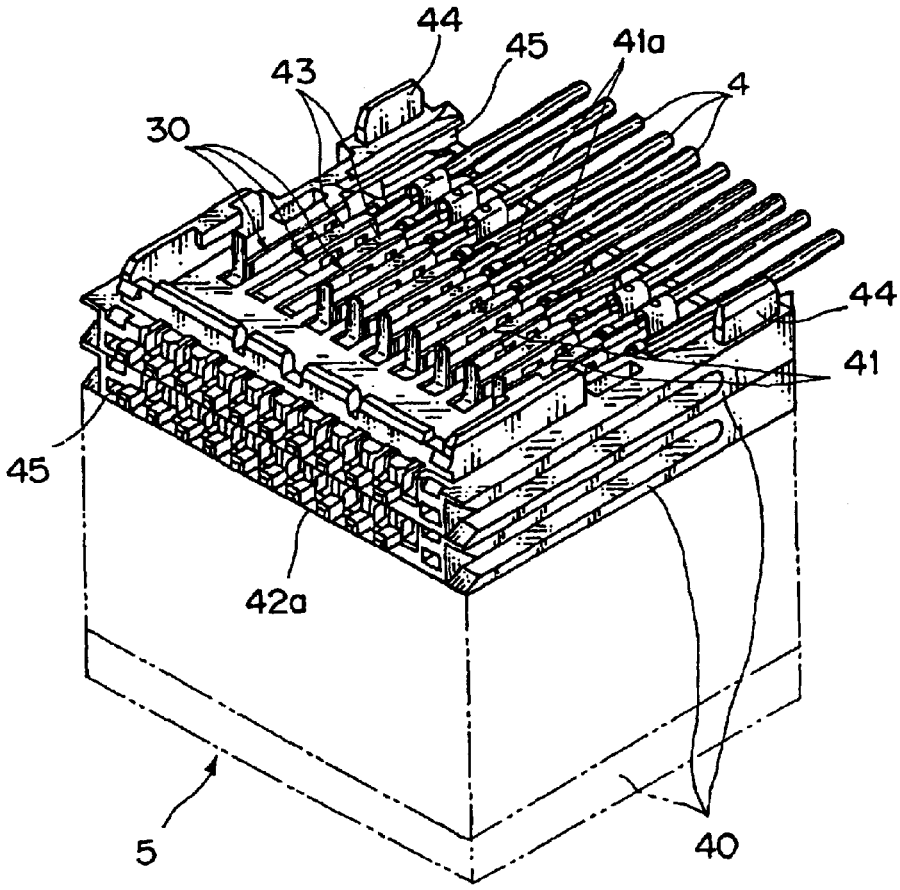
FIG. 36 is a perspective view showing a connector constituted by layering a plurality of the terminal housing of FIG. 34.

The terminal housings 40 which have received the terminals 30 are layered one another such that the plate main bodies 42 are parallel to each other with a space therebetween to define a joint connector 5 as illustrated in FIG. 36.

Note that the joint connector is generally a connector in which terminals are electrically connected according to a predetermined pattern and has a plurality of layered connector housings like the terminal housing 40.

Figure 34:
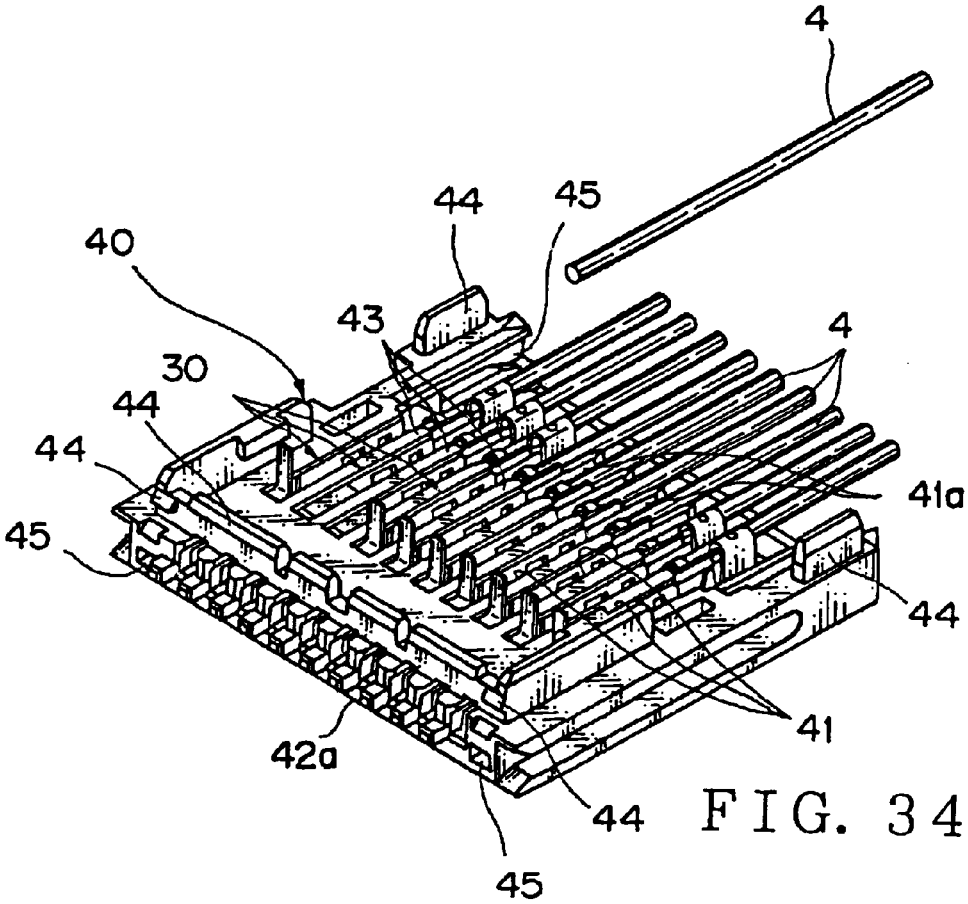
FIG. 34 is a perspective view showing a state in which electrical cables are press-fitted to the terminals mounted in the terminal housing of FIG. 33.
Figure 35:
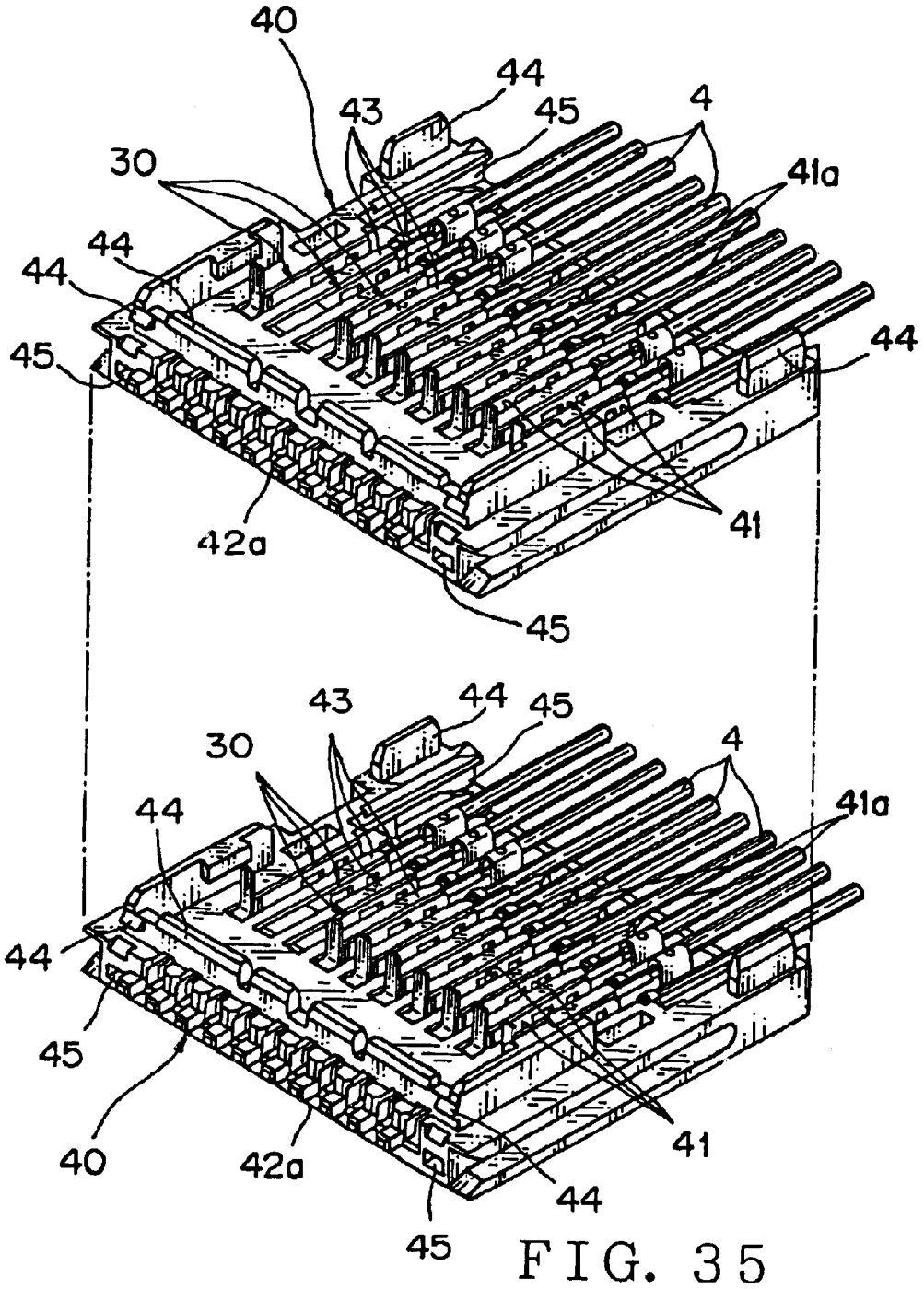
FIG. 35 is a perspective view showing a state in which a plurality of the terminal housings of FIG. 34 are layered with a space therebetween.

As illustrated in FIG. 34, the terminals 30*a* which have been received in the terminal housing 40*a* are press-fitted to the electrical cables 4. And, as illustrated in FIG. 35, the terminal housings 40 with the electrical cables 4 are layered one another.

In the example shown in FIGS. 33 to 36, each terminal insertion channels 41 receives the terminal 30. However, all the terminal insertion channels 41 of the terminal housing 40 need not receive the terminal 30. That is, predetermined ones of the terminal insertion channels 41 of the terminal housing 40 for constituting the connector 5 receive the terminal 30.

Furthermore, the terminal housing 40 has a plurality of lock projections 44 and locking holes 45 engageable with the lock projections. The engagement of the lock projections 44 with the locking holes 45 secures the layered terminal housings 40 to each other. The terminal housing 40 also has a plurality of through holes (not shown) so that the connection portion 37 of a lower press-fit terminal 30 can enter the opening 36 of an upper press-fit terminal 30*a*.

Figure 1:
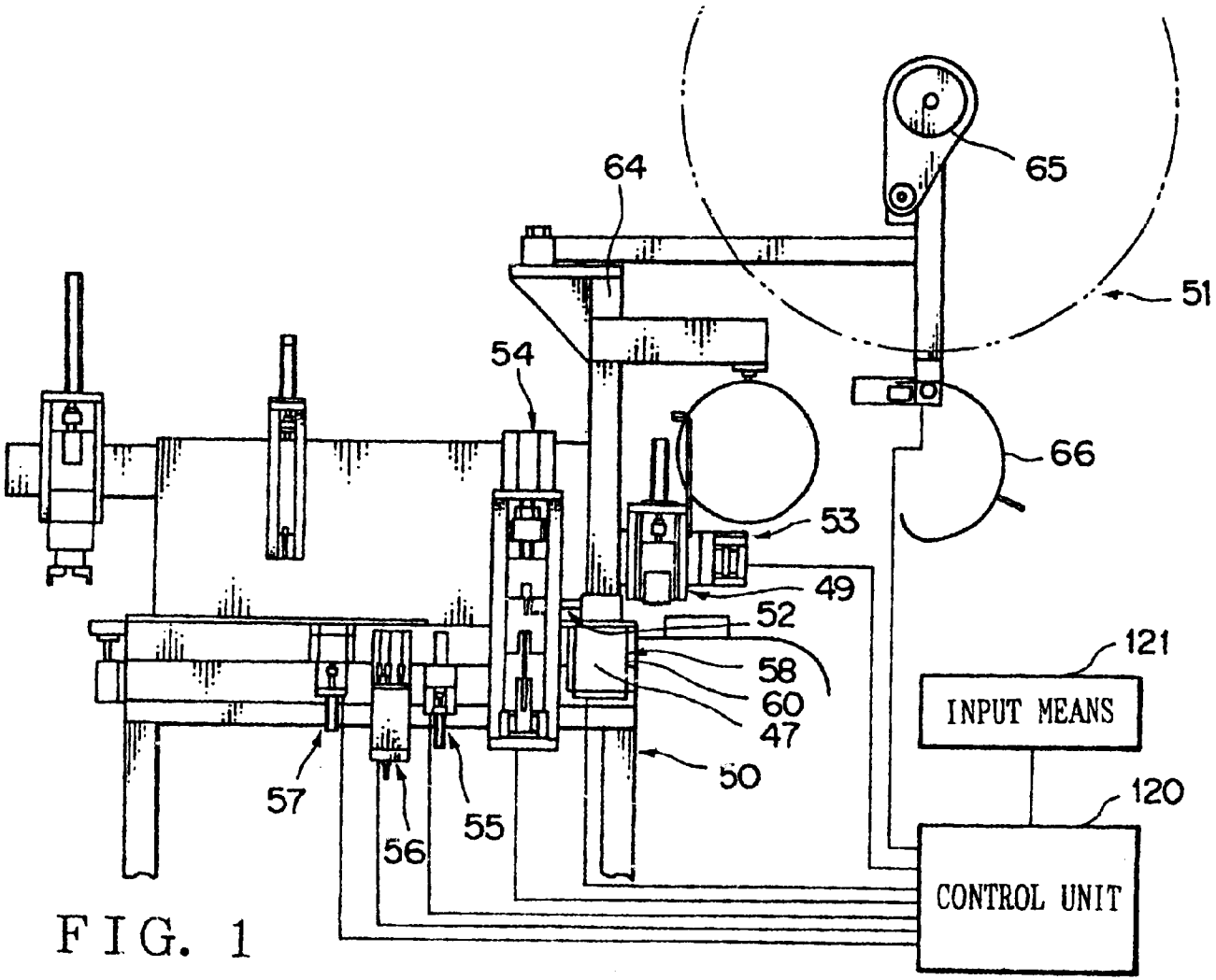
FIG. 1 is a side view showing a terminal mounting apparatus of an embodiment according to the present invention.
Figure 2:
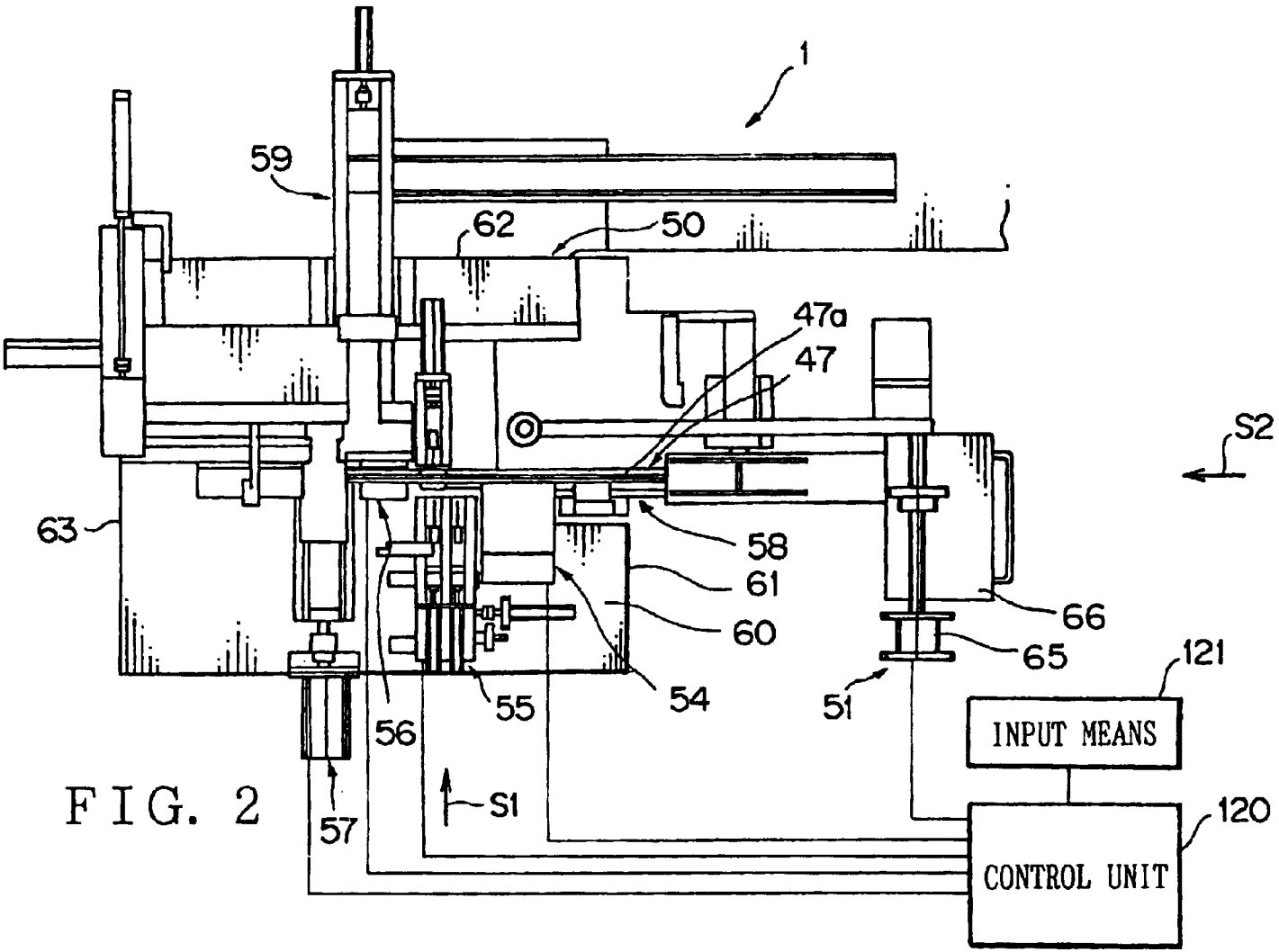
FIG. 2 is a plan view showing a configuration of the terminal mounting apparatus of the embodiment.
Figure 3:
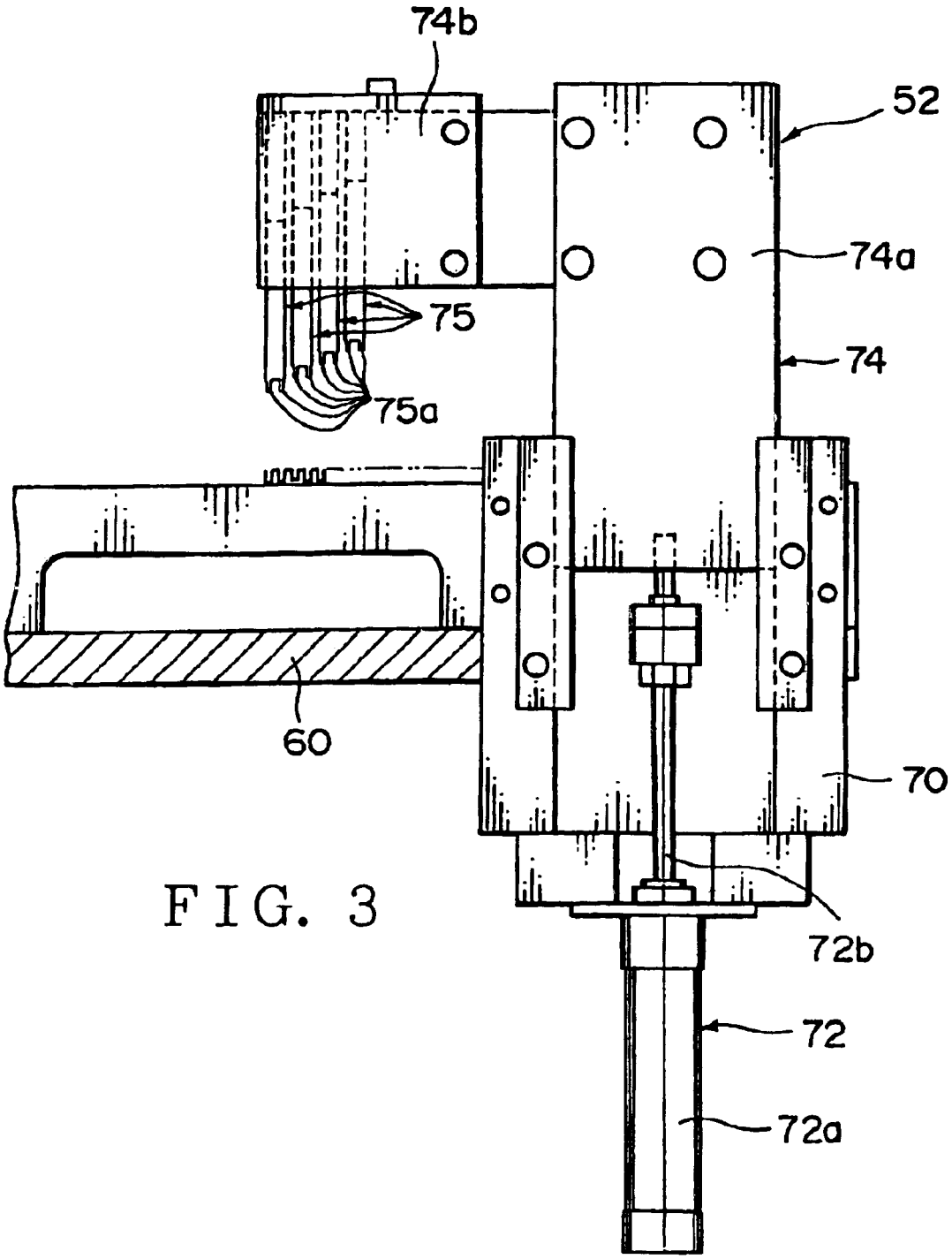
FIG. 3 is a view taken along an arrow S1 of FIG. 2 regarding a terminal positioning unit of the terminal mounting apparatus of the embodiment.

As illustrated in FIGS. 1 and 2, the terminal mounting apparatus 1 has a base 50, a terminal feed route 58, a housing feed route 59, a jointed terminal assembly feed unit 51, a terminal positioning unit 52 which is a terminal space adjusting means, a transfer unit 53 which is a terminal holding means, a carrier cutting unit 54 which is a joint portion removing means, a tab bending unit 55 which is a connection portion moving means, a separator 56 which is a second terminal space adjusting means, an insertion unit 57 which is a terminal insertion means, a control unit 120 which is a control means, and an input means 121.

Downstream along the terminal feed route 58 of the terminals 30, there are sequentially disposed the jointed terminal assembly feed unit 51, the terminal positioning unit 52, the carrier cutting unit 54, the tab bending unit 55, the separator 56, and the insertion unit 57.

The base 50 is disposed generally on a floor in a factory. The base 50 has a bed 60 having a substantially flat upper surface, a vertical support 64, and through holes 67*a*, 67*b*. The bed 60 has a generally rectangular shape in plan as illustrated in FIG. 2. The vertical support 64 is fixed to the bed 60 and extends upward from the bed 60.

Figure 9:
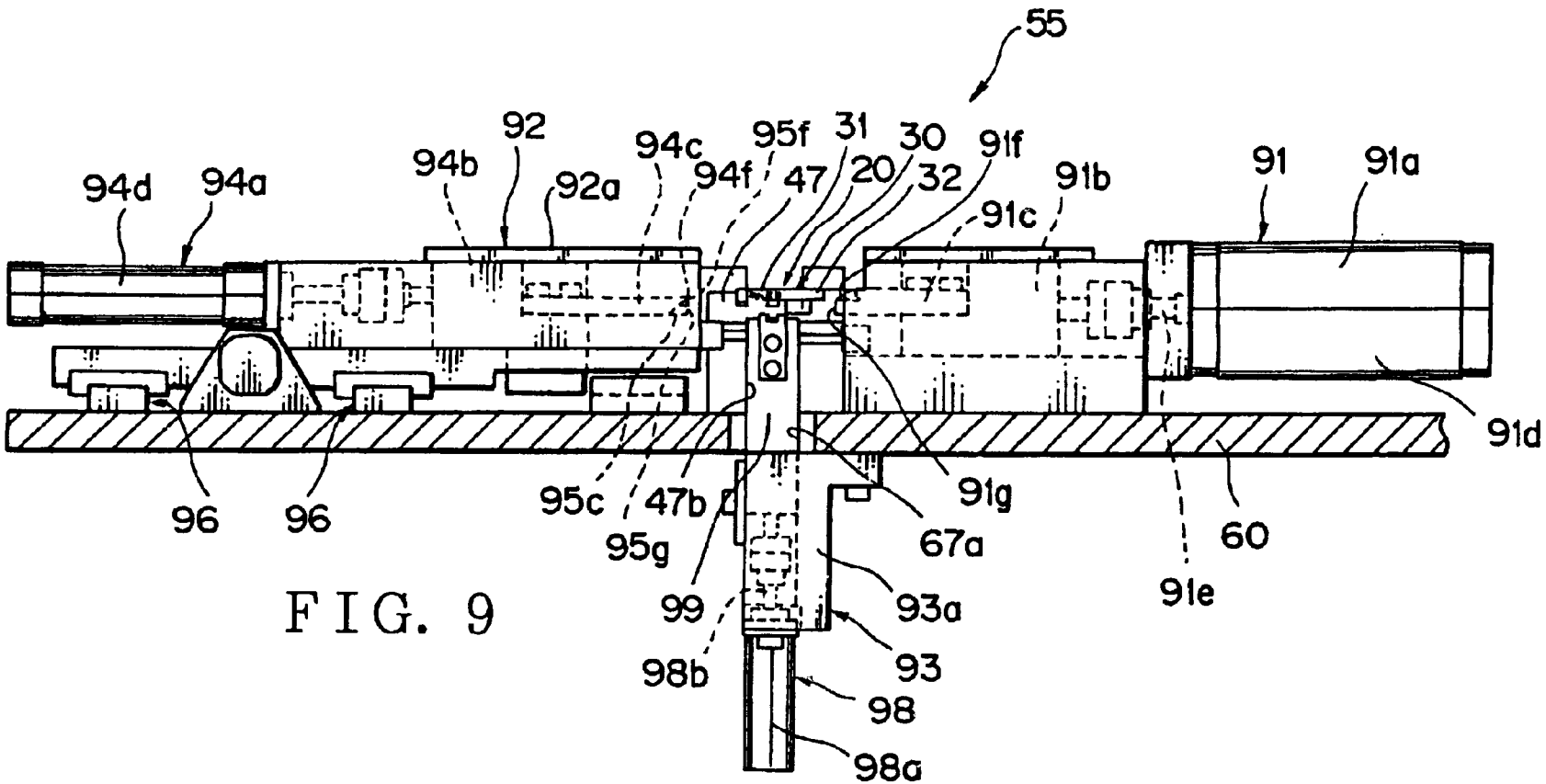
FIG. 9 is a view taken along the arrow S2 of FIG. 2 for showing a tab bending unit of the terminal mounting apparatus of the embodiment.
Figure 10:
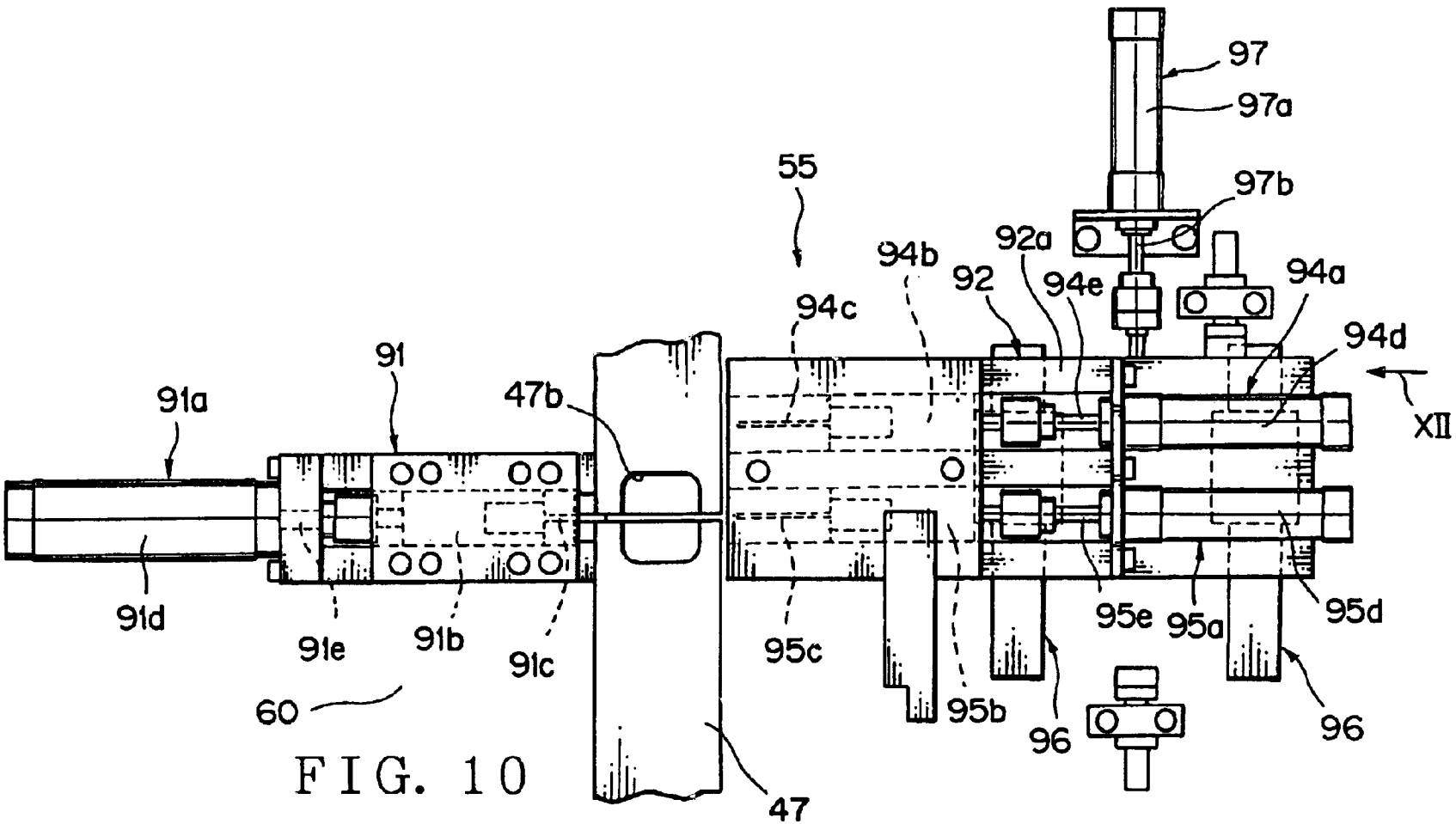
FIG. 10 is a plan view showing the tab bending unit of FIG. 9.
Figure 12:
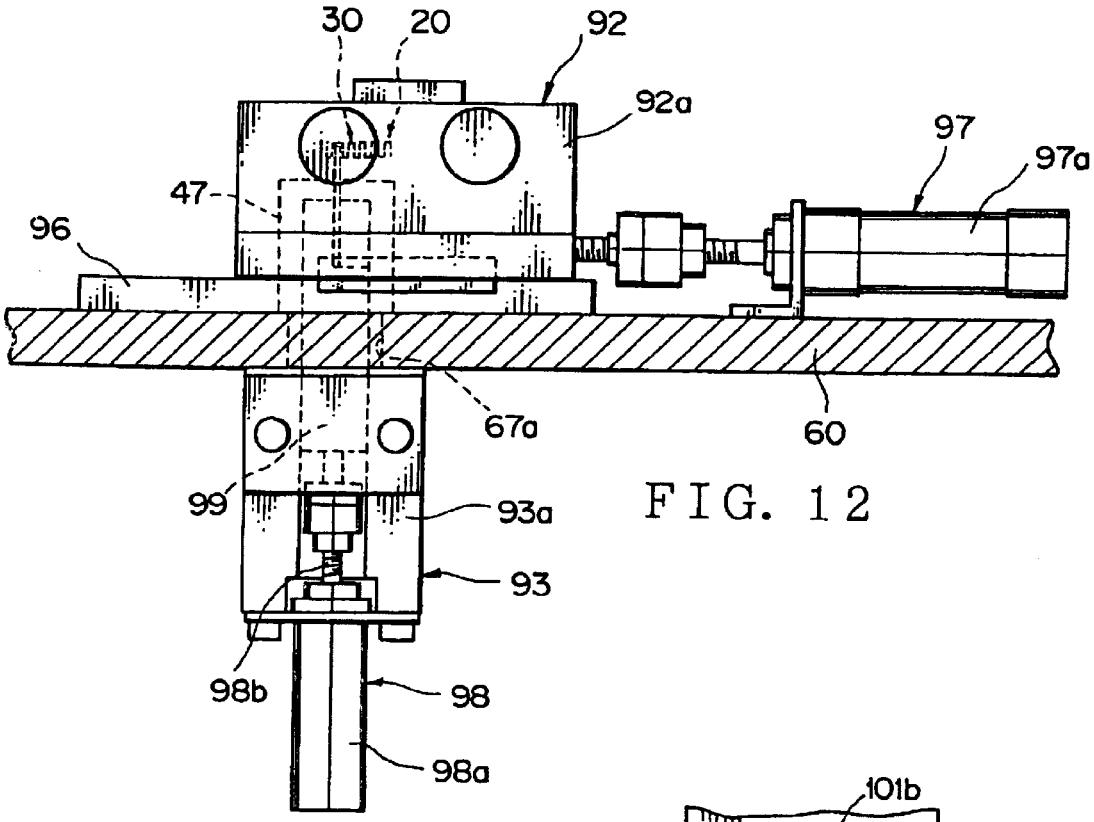
FIG. 12 is a view taken along the arrow XII of FIG. 10 for showing the tab bending unit of FIG. 9.
Figure 14:
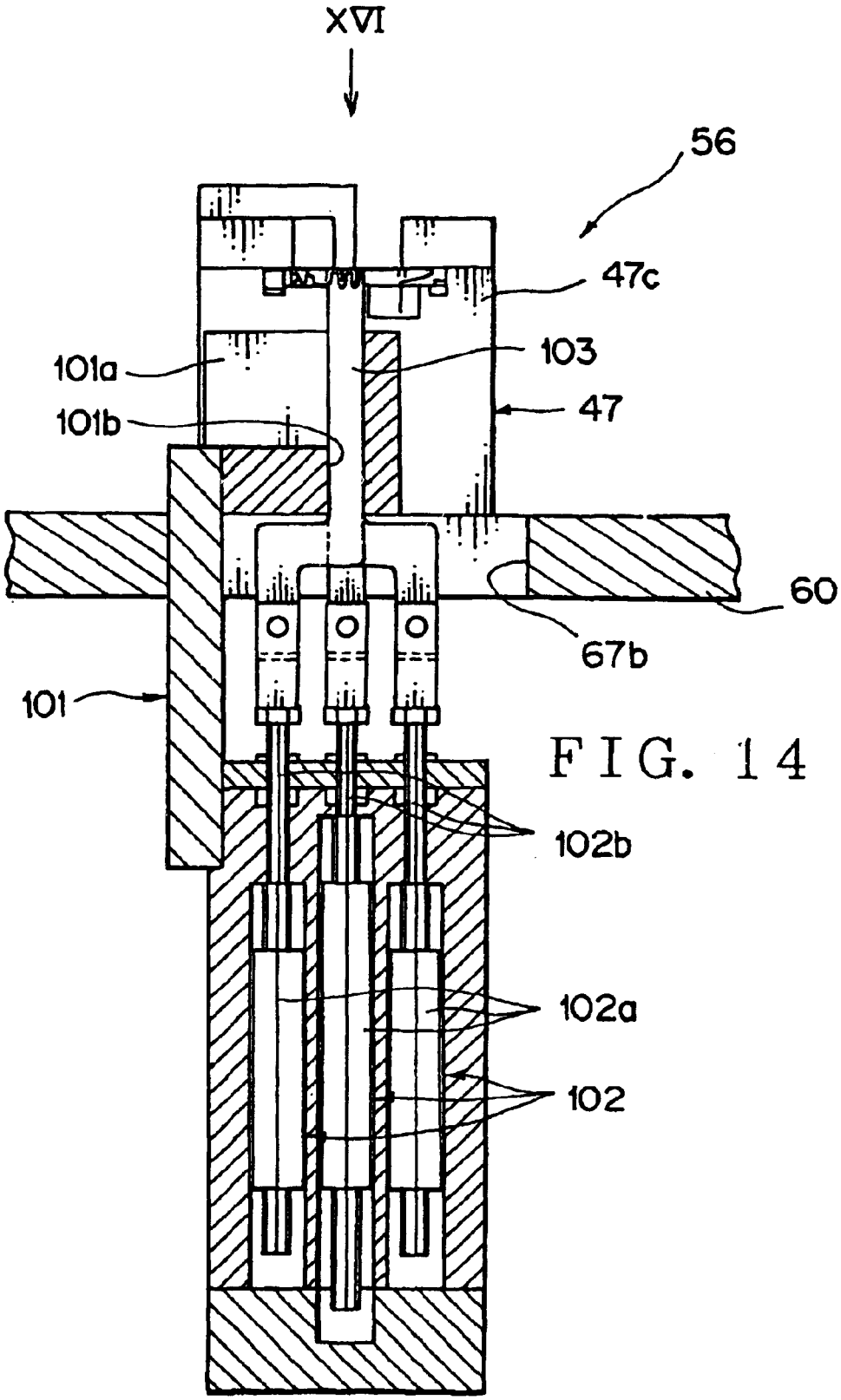
FIG. 14 is a partial sectional view taken along the arrow S2 of FIG. 2 for showing the separator of FIG. 13.

The through holes 67*a*, 67*b* are formed in the bed 60. The through hole 67*a* is located near the tab bending unit 55 in a lower face side of a terminal base 47 (discussed later) as illustrated in FIG. 9. The through hole 67*b* is located near the separator 56 in the lower face side of the terminal base 47 as illustrated in FIG. 14.

The terminal feed route 58 is arranged on the bed 60 and extends along a longitudinal direction of the bed 60 from an edge 61 to a middle portion of the bed 60 as illustrated in FIG. 2. The terminal base 47 and a terminal carrier 49 (discussed later) of the transfer unit 53 in the terminal feed route 58 transfers the jointed terminal assembly 20 of the terminals 30 from the edge 61 to the middle portion of the bed 60 by using the jointed terminal assembly feed unit 51.

The housing feed route 59 is arranged on the bed 60. As illustrated in FIG. 2, the housing feed route 59 extends from the edge 61 to another edge 62 toward the terminal feed route 58 and turns at a position near the terminal feed route 58 toward an edge 63 opposed to the edge 61.

Along the housing feed route 59, the terminal housing 40 having no press-fit terminals 30 in the terminal insertion channels 41 is supplied from the side of the edge 62. The housing feed route 59 transfers all at once the terminal housing 40 supplied from the side of the edge 62 toward the terminal feed route 58.

After the terminals 30 are inserted into the terminal insertion channels 41 of the terminal housing 40 at a position near the terminal feed route 58, the housing feed route 59 transfers the terminal housing 40 having the terminals 30 toward the edge 63. Note that the housing feed route 59 transfers the terminal housing 40 with a bottom surface 42*a* (best shown in FIG. 31) of the plate main body 42 being exposed upward.

As illustrated in FIGS. 1 and 2, the jointed terminal assembly feed unit 51 has a reel 65 and a guide plate 66. The reel 65 holds the jointed terminal assemblies 20 which are continuously wound thereon. The guide plate 66 guides the jointed terminal assemblies 20 to feed them from the reel 65 into the terminal feed route 58. The jointed terminal assembly feed unit 51 feeds the jointed terminal assemblies 20 from the reel 65 into the terminal feed route 58.

The terminal positioning unit 52 is disposed near the terminal feed route 58 and is positioned in an upstream side of the terminal feed route 58. That is, the terminal positioning unit 52 is located near the edge 61 and the jointed terminal assembly feed unit 51.

Figure 4:
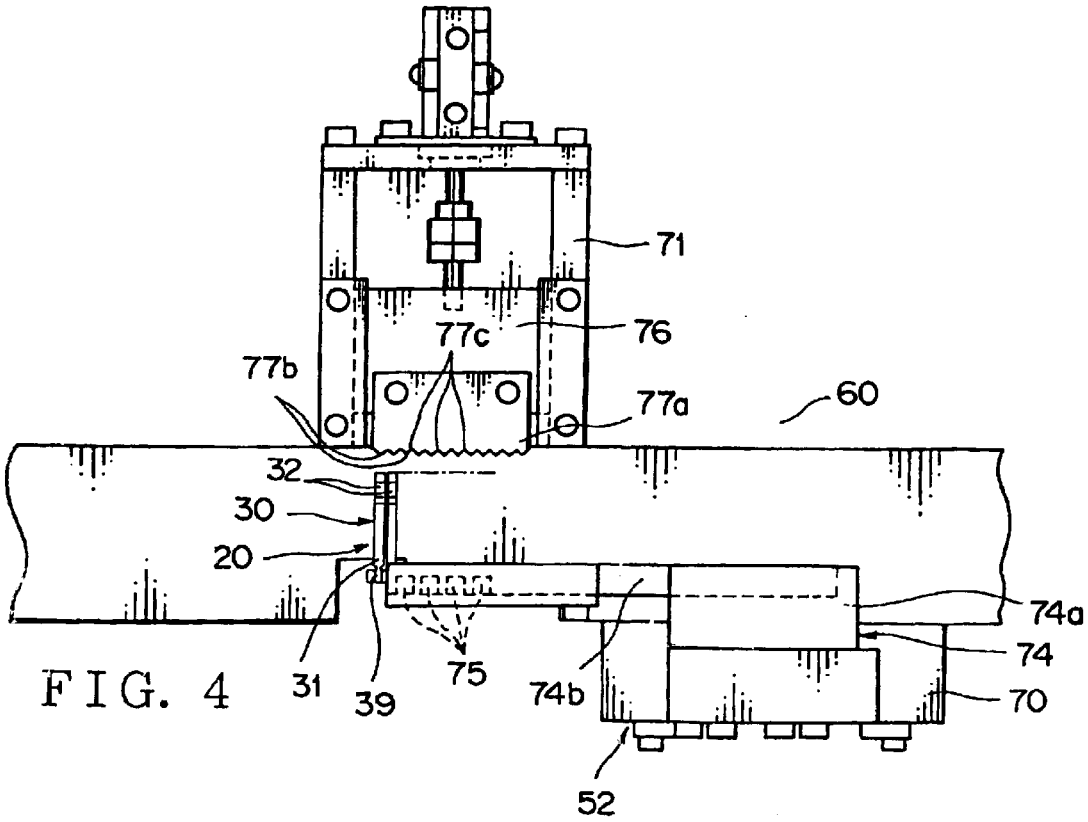
FIG. 4 is a plan view showing the terminal positioning unit of FIG. 3.
Figure 5:
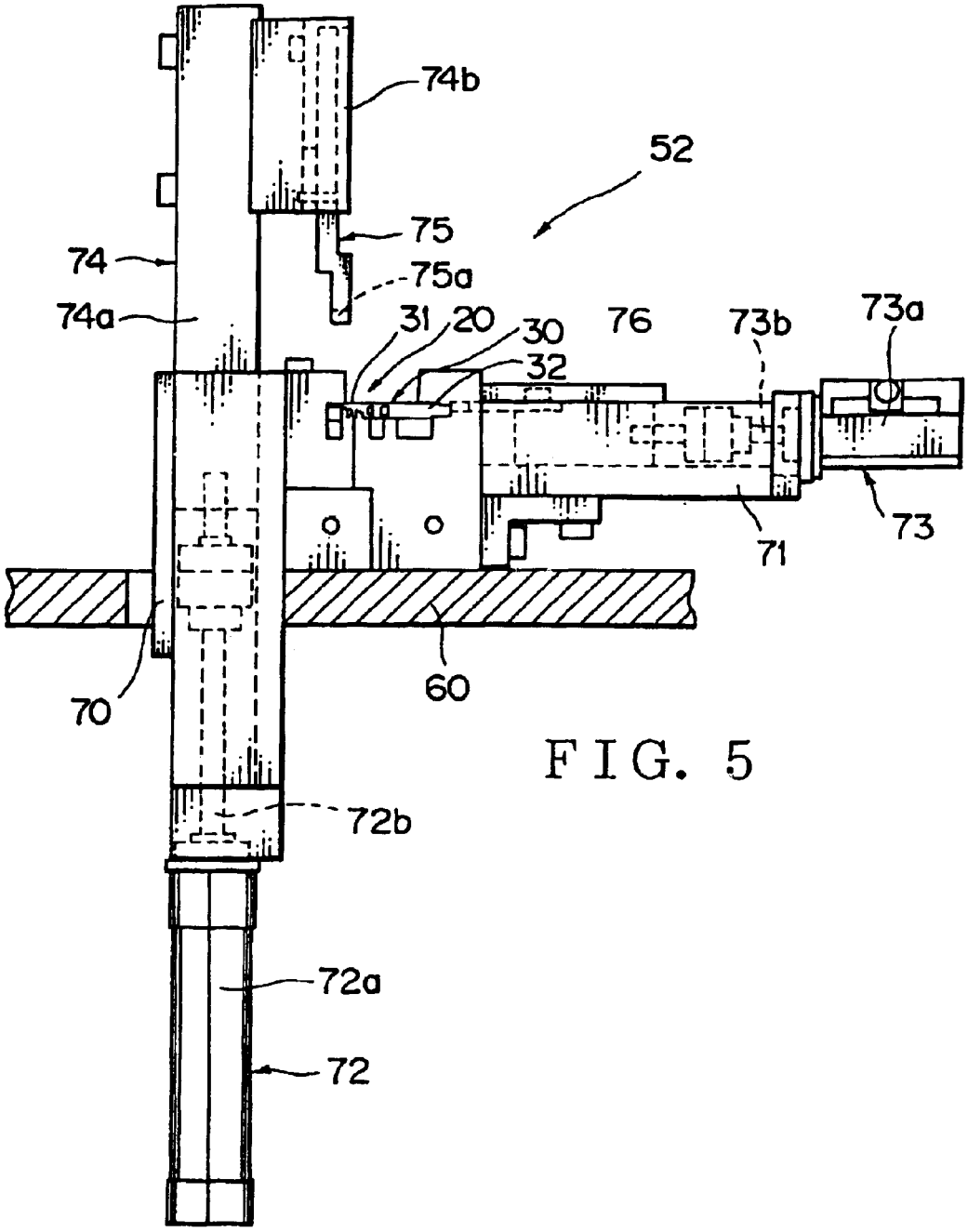
FIG. 5 is a view taken along an arrow S2 of FIG. 2 regarding the terminal positioning unit of FIG. 3.

As illustrated in FIGS. 3 to 5, the terminal positioning unit 52 has a first unit main body 70, a second unit main body 71, an air cylinder 72, another air cylinder 73, an elevating block 74, a plurality of terminal clamps 75 which are adjustment bars, a sliding base 76, and an alignment blade 77 which is an alignment member.

The first unit main body 70 is a vertically extended cylinder having a bottom. The first unit main body 70 is fixed on the bed 60 with the bottom being positioned downward.

The second unit main body 71 is fixed on the bed 60 via a terminal base 47 (discussed later) of the transfer unit 53. The second unit main body 71 is a plate frame disposed on an upper surface of the bed 60.

The air cylinder 72 has a cylinder main body 72*a* and an extendable rod 72*b* extended from the cylinder main body 72*a*. The cylinder main body 72*a* is fixed on a bottom of the first unit main body 70. The extendable rod 72*b* is joined to an end of the elevating block 74.

The air cylinder 73 has a cylinder main body 73*a* and an extendable rod 73*b* extended from the cylinder main body 73*a*. The cylinder main body 73*a* is fixed on the second unit main body 71. The extendable rod 73*b* is joined to the sliding base 76.

The elevating block 74 moves upward and downward vertically relative to the first unit main body 70. The elevating block 74 has a vertically extended column 74*a* slidingly supported by the first unit main body 70 and has an arm 74*b* which is extended from an upper end of the column 74*a* to downward oppose to the terminals 30 supplied along the terminal feed route 58. The air cylinder 72 moves the extendable rod 72*b* so that the elevating block 74 moves vertically.

As best shown in FIG. 3, each terminal clamp 75 is a rod held by the arm 74*b* and extends vertically. The terminal clamp 75 has a lower end opposed to the terminal 30 supplied along the terminal feed route 58. The terminal clamp 75 is held by the arm 74*b* so that the terminal clamp 75 can be movable close to and apart from the terminal 30. The terminal clamps 75 are disposed in parallel with each other in a transfer direction of the terminal feed route 58. Note that there are provided four of the terminal clamp 75 in the example shown in the drawing.

Each terminal clamp 75 has a pair of tabs 75*a*, 75*a* at the lower end thereof. The distance between the tabs 75*a*, 75*a* is substantially equal to a width of the connection wall 35*a* of the terminal 30. A space between a tab 75*a* of one terminal clamp 75 and another tab 75*a* of another tab clamp 75 adjacent to the one terminal clamp 75 is substantially equal to the width of the connection wall 35*a* of the terminal 30.

The terminal clamp 75 can pinch an end of the connection wall 35*a* of the joint portion 39 of the terminal 30 between the adjacent tabs 75*a*.

Furthermore, a space between a tab 75*a* of one terminal clamp 75 and another tab 75*a* of another tab clamp 75 adjacent to the one terminal clamp 75 is substantially equal to a space between adjacent two of the terminals 30 inserted into the terminal insertion channels 41. That is, the space between adjacent tabs 75*a* is substantially equal to the space between the adjacent press-fit terminals 30.

The terminal clamp 75 is urged from the arm 74*b* by a spring (not shown) or the like so that the tabs 75*a*, 75*a* come close to the terminals 30. When the terminal clamps 75 have not pinched the connection walls 35*a* of the terminals 30 between the tabs 75*a*, the terminal clamps 75 each have an extended length different from each other. That is, the lengths extended from the arm 74*b* of the terminal clamps 75 gradually vary to be longer toward an upstream side of the terminal feed route 58.

The sliding base 76 is slidingly supported on the second unit main body 71 and can move close to and away from the terminal feed route 58. The air cylinder 73 moves the extendable rod 73*b* so that the sliding base 76 sides toward and away from the terminal feed route 58.

The alignment blade 77 is joined to an end of the sliding base 76 in the side of the terminal feed route 58. The alignment blade 77 is a plate parallel to the bed 60. The alignment blade 77 has an end portion 77*a* which is opposed to an end of the electrical contact portion 32 of the terminal 30 supplied by the terminal feed route 58.

The end portion 77*a* of the alignment blade 77 has a plurality of peaks 77*b* and valleys 77*c*. The peaks 77*b* and valleys 77*c* are alternately formed in the direction of the terminal feed route 58. The peaks 77*b* and the valleys 77*c* face ends of the electrical contact portion 32 of the terminal 30.

The peak 77*b* and the valley 77*c* of the alignment blade 77 are contiguous with each other via an inclined surface 77*d* (best shown in FIG. 20) inclined to come close or away from the terminal feed route 58. The spacing of the peaks 77*b* is substantially equal to the space between adjacent two of the terminals 30 which will be inserted into the terminal insertion channels 41.

Thus configured alignment blade 77 contacts the side walls 35*b*, 35*b* of the terminal 30 at the inclined surfaces 77*d* thereof, when the extendable rod 73*b* of the air cylinder 73 extends. With a further extension of the extendable rod 73*b*, the inclined surfaces 77*d* guide the electrical contact portion 32 such that the space between the electrical contact portions 32 of the adjacent the terminals 30 is equal to a predetermined space with which the terminals 30 will be inserted into the terminal insertion channels 41.

When the terminals 30 have not been supplied the terminal feed route 58 by the jointed terminal feed unit 51, the extendable rod 72*b* of the air cylinder 72 of thus configured terminal positioning unit 52 is extended as illustrated in FIG. 3, and the extendable rod 73*b* of the air cylinder 73 is retracted as illustrated in FIG. 4.

When the terminals 30 have been supplied from the jointed terminal feed unit 51 into the terminal feed route 58, the extendable rod 72*b* of the air cylinder 72 is retracted and the extendable rod 73*b* of the air cylinder 73 is extended.

Figure 20C:
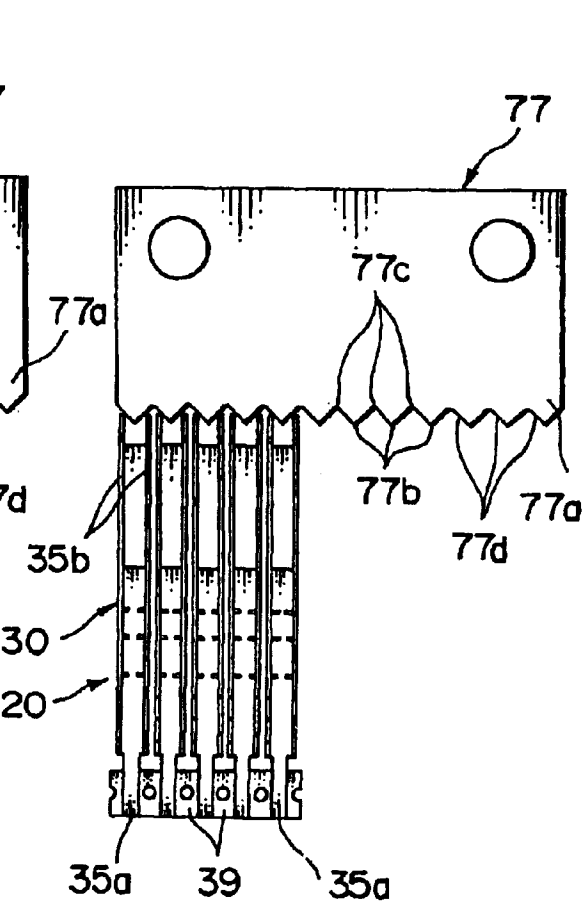
FIGS. 20A to 20C are illustrations showing steps for adjusting spaces between the terminals by means of an alignment blade of the terminal positioning unit of FIG. 3.
Figure 20B:
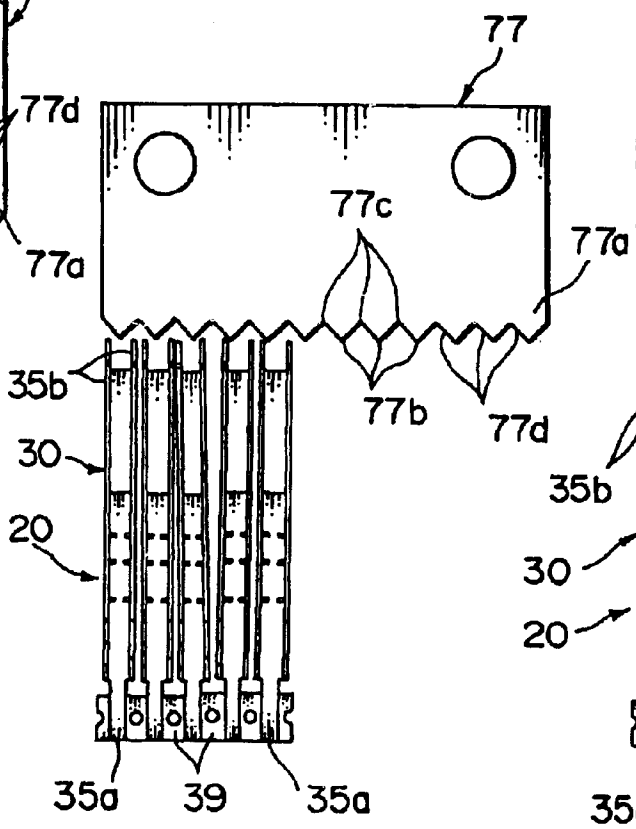
Figure 20A:
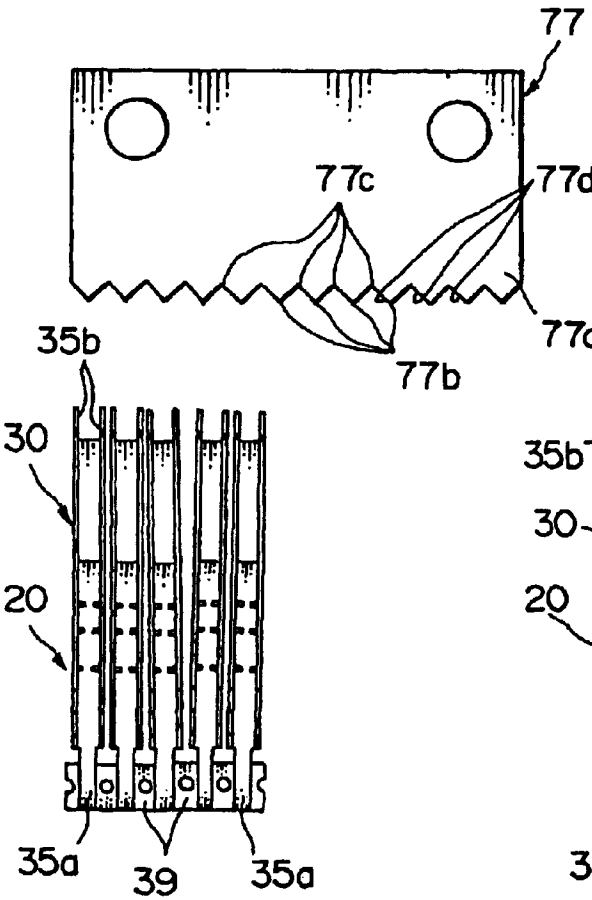

Thereby, as illustrated in FIGS. 19A to 19E, each terminal clamp 75 comes close to an end of the connection wall 35*a* positioned in the side of the joint portion 39 of the terminal 30. As illustrated in FIGS. 20A to 20C, the peaks 77*b* and the valleys 77*c* of the alignment blade 77 come close to ends of the electrical contact portions 32 of the terminals 30.

Each terminal clamp 75 pinches ends of the connection wall 35*a* in the side of the joint portion 39 of the terminal 30 between the tabs 75*a*, 75*a* sequentially in a downstream direction of the terminal transfer. The terminal clamp 75 corrects the spaces between the cable connection portions 31 to allow the terminal 30 to be inserted into the terminal insertion channels 41.

Each peak 77*b* enters between the side walls 35*b* of each press-fit terminal 30, and the side walls 35*b* contact the inclined surfaces 77*d*. Thereby, the inclined surfaces 77*d* guide the side walls 35*b*, so that the alignment blade 77 corrects the spaces between the electrical contact portions 32 to allow the terminals 30 to be inserted into the terminal insertion channels 41.

As described above, the spaces between the tabs 75*a*, 75*a* as well as the spaces between the peaks 77*b* are predetermined to be equal to the spaces between the terminals 30 which will be inserted into the terminal insertion channels 41. Thus, the terminal positioning unit 52 corrects the spaces between the terminals 30 to allow the terminals to be inserted into the terminal insertion channels 41.

Each tab 75*a* of each terminal clamp 75 enters between the joint portions 39 of the terminals 30 of the jointed terminal assembly 20 sequentially from an upstream one of terminal clamps. Thereby, the terminal clamps 75 can surely correct the spaces between the terminals 30 to allow them to be inserted into the terminal insertion channels 41.

Figure 6:
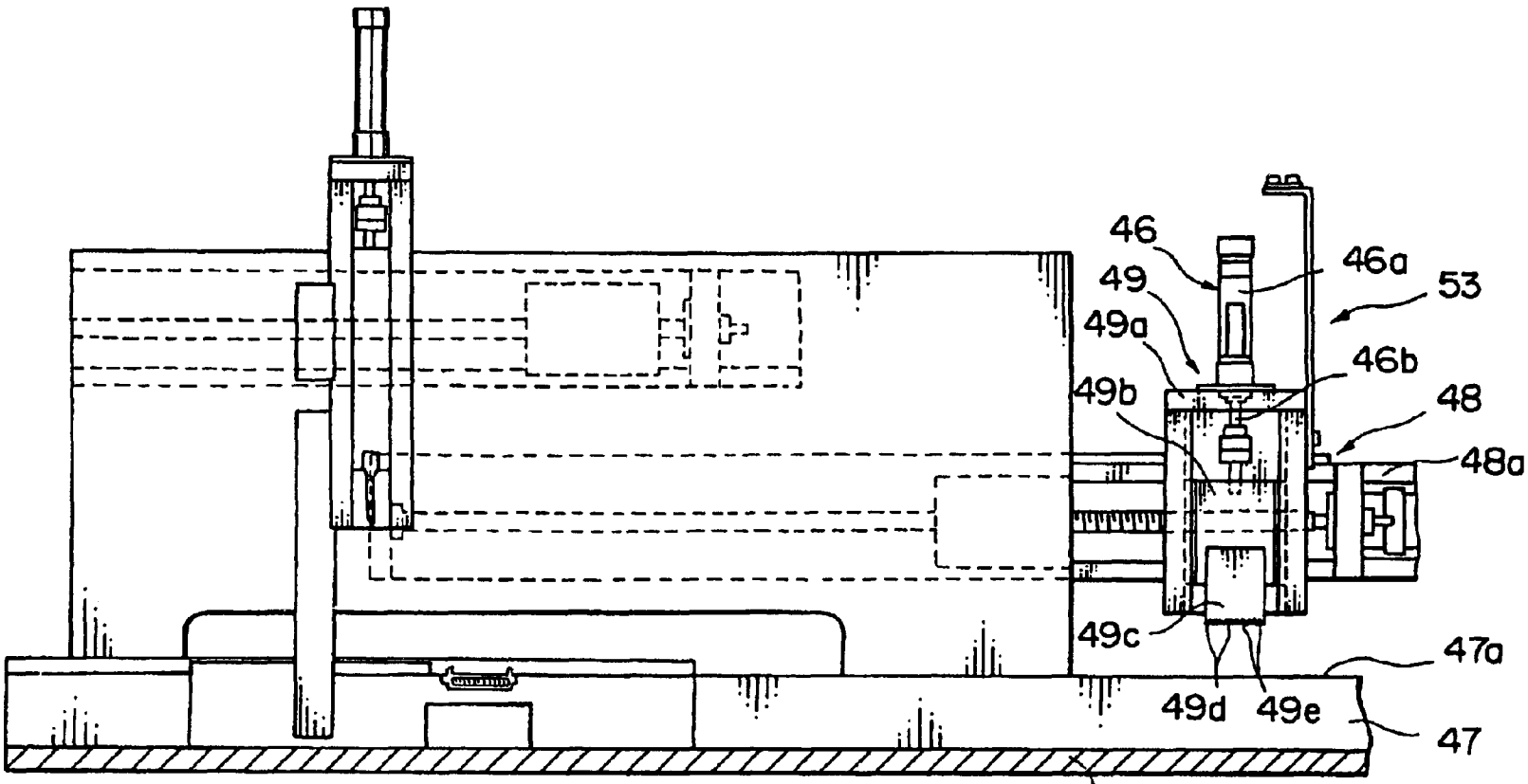
FIG. 6 is a view taken along the arrow S1 of FIG. 2 regarding a transfer unit of the terminal mounting apparatus of the embodiment.

Referring to FIG. 6, the transfer unit 53 has a terminal base 47, a linear guide 48, and the terminal carrier 49. The terminal base 47 is fixed on an upper surface of the bed 60. The terminal base 47 is in an elongated box shape longitudinally extended along the bed 60. The terminal base 47 extends across the proximity of the jointed terminal assembly feed unit 51 and the proximity of the insertion unit 57.

The terminal base 47 has an upper surface 47*a* along the bed 60 for supporting the terminals 30 of the jointed terminal assembly 20 which is transferred from the jointed terminal assembly feed unit 51. At an end of the terminal base 47 near the jointed terminal assembly feed unit 51, the terminals 30 in the form of the jointed terminal assembly 20 are supplied from the feed unit 51.

The upper surface 47*a* of the terminal base 47 constitutes a part of the terminal feed route 58. The terminal base 47 has an opening 47*b* (see FIG. 9) positioned near the tab bending unit 55 and an opening 47*c* (see FIG. 14) positioned near the separator 56. The opening 47*b* penetrates vertically through the terminal base 47 and aligns with the through hole 67*a*. The opening 47*c* penetrates vertically through the terminal base 47 and aligns with the through hole 67*b*.

The linear guide 48 has a guide rail 48*a* fixed to the vertical support 64 and has a slider (not shown). The guide rail 48*a* extends along the terminal feed route 58 across the jointed terminal assembly feed unit 51 and the insertion unit 57. The slider is slidingly supported by the guide rail 48*a*.

The terminal carrier has a unit main body 49*a*, an air cylinder 46, a slide block 49*b*, and a carry holder 49*c*. The unit main body 49*a* is joined to the slider (not shown) mounted on the linear guide 48.

The air cylinder 46 has a cylinder main body 46*a* and an extendable rod 46*b* extended from the cylinder main body 46*a*. The cylinder main body 46*a* is fixed to the unit main body 49*a*. The extendable rod 46*b* has a fore end joined to the slide block 49*b*.

The slide block 49*b* is vertically slidingly supported by the unit main body 49*a* such that the slide block 49*b* comes close to and apart from the terminals 30 disposed on the terminal base 47. The slide block 49*b* comes close to and apart from the terminals 30 according to the movement of the extendable rod 46*b* of the air cylinder 46.

The carry holder 49*c* is a vertically elongated plate and is fitted to an end of the slide block 76 near the terminal base 47. The carry holder 49*c* has a plurality of second tabs 49*d* which can be opposed to the terminals 30.

The second the tabs 49*d* protrudes to be opposed to the terminals 30 and are equally spaced from each other along a transfer direction of the terminals 30. The space between the adjacent second tabs 49*d* is substantially equal to the width of the press-fit portion 31*a* of the terminal 30.

That is, the space between the adjacent second tabs 49*d* is substantially equal to an outer distance of the side walls 35*b*, 35*b* of the terminal 30. Thus, the terminal 30 can be held between the adjacent second tabs 49*d*.

While the terminal positioning unit 52 is adjusting spaces between the terminals 30, the extendable rod 46*b* of the air cylinder 46 of thus configured transfer unit 53 is retracted so that the carry holder 49*c* is apart from the terminals 30.

Figure 21:
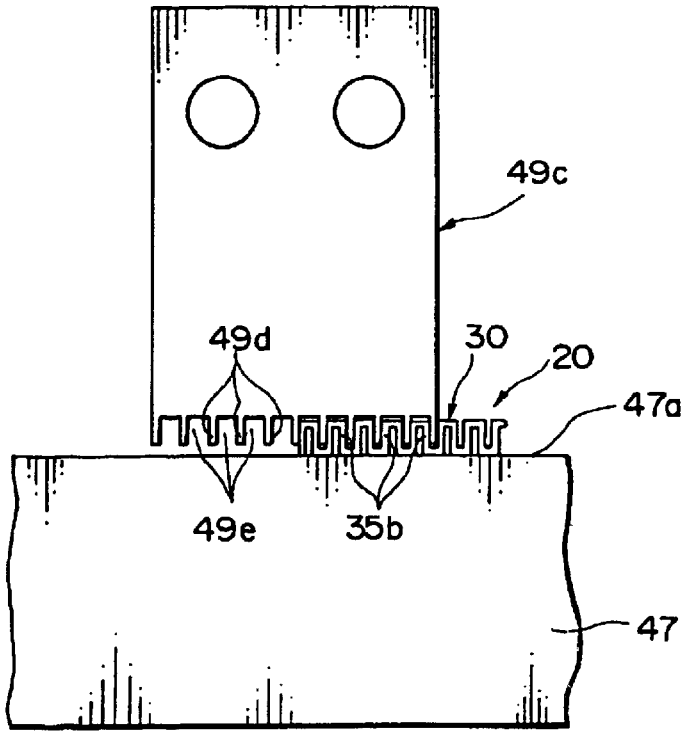
FIG. 21 is a view showing a state in which the carry holder of the transfer unit of FIG. 6 transfers the terminals.

After the terminal positioning unit 52 has adjusted the spaces between the terminals 30, the extendable rod 46*b* of the air cylinder 46 moves forward so that the second the tabs 49*d* hold the terminals 30 therebetween. The terminal carrier 49 and the slider slide along the guide rail 48*a* to transfer the terminals 30 on the upper surface 47*a* of the terminal base 47 as illustrated in FIG. 21.

The carry holder 49*c* of the transfer unit 53 can hold the required number of the terminals 40 for one of the terminal housings 40. As illustrated in FIG. 21, the spaces 49*e* receive the terminals 30 sequentially from the most upstream one in the terminal transfer direction.

Figure 7:
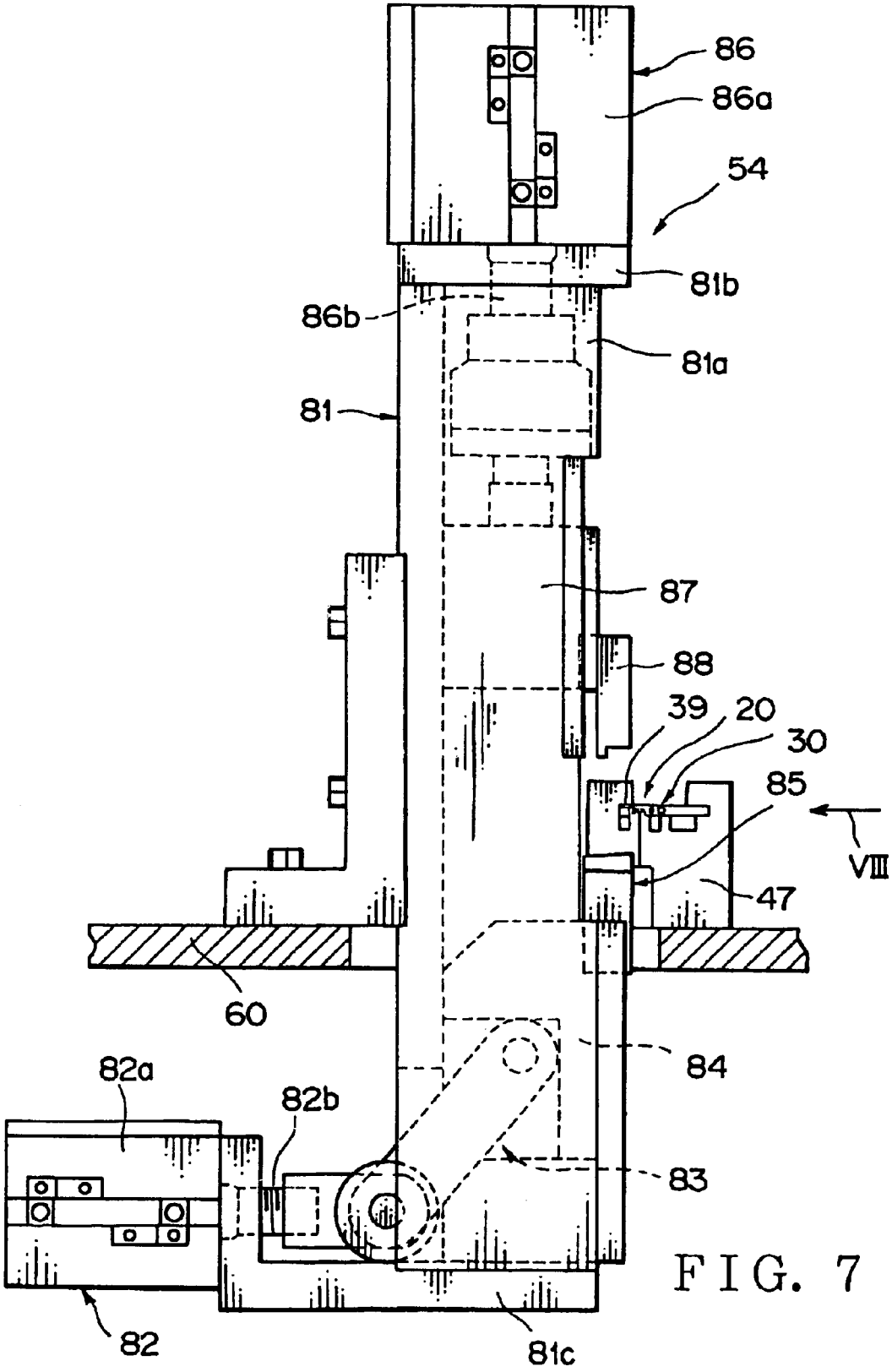
FIG. 7 is a view taken along the arrow S2 of FIG. 2 for showing a carrier cutting unit of the terminal mounting apparatus of the embodiment.
Figure 8:
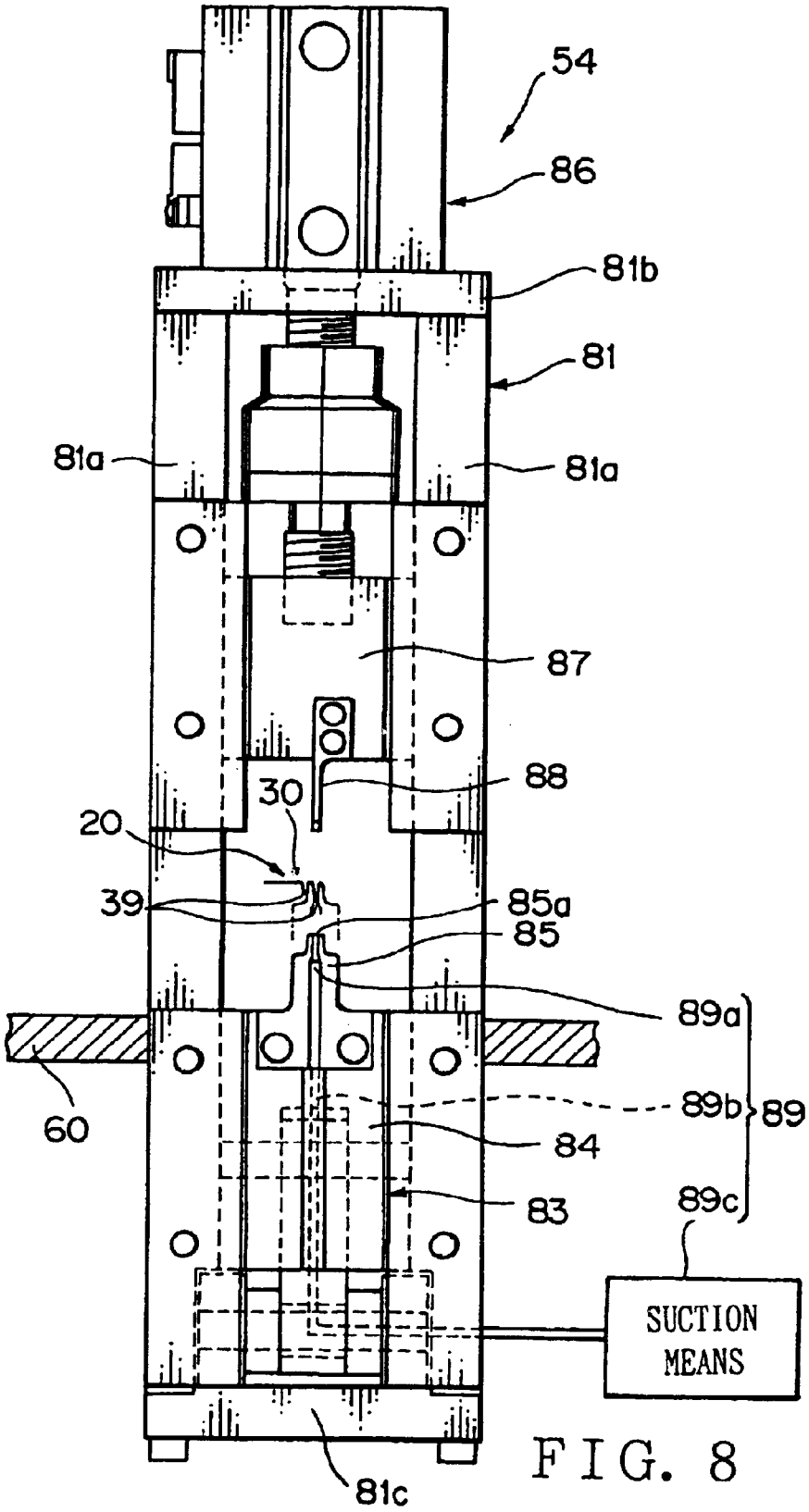
FIG. 8 is a view taken along the arrow VII of FIG. 7 for showing the carrier cutting unit of FIG. 7.

The carrier cutting unit 54 is arranged near the terminal feed route 58 and the terminal positioning unit 52. As illustrated in FIGS. 7 and 8, the carrier cutting unit 54 has a unit main body 81, an air cylinder 82, a link 83, a die holder 84, a lower die 85 which is a cutting die, an air cylinder 86, a die holder 87, an upper die 88 which is a cutting die, and a removing piece discharge means 89.

The unit main body 81 has a pair of parallel plates 81*a*, 81*a* and a pair of joint members 81*b*, 81*c*. Each plate 81*a* is fixed to the bed 60 at a longitudinal middle of the plate and extends vertically. The joint members 81*b*, 81*c* each joint upper or lower ends of the plates 81*a*, 81*a* .

The air cylinder 82 has a cylinder main body 82*a* and an extendable rod 82*b* extended from the cylinder main body 82*a*. The cylinder main body 82*a* is fixed to the joint member 81*c* such that the extendable rod 82*b* is oriented along the bed 60. The extendable rod 82*b* is coupled to the link 83.

The link 83 operably connects the extendable rod 82*b* to the die holder 84. The link 83 vertically elevates the die holder 84 according to the movement of the extendable rod 82*b*.

The die holder 84 is mounted between lower end portions of the plates 81*a*, 81*a*. The die holder 84 moves vertically parallel to longitudinal directions of the plates 81*a*, 81*a*. The die holder 84 moves upward via the link 83 by the extension of the rod 82*b* of the air cylinder 82.

The lower die 85 is fitted on an upper end portion of the holder 84. The lower die 85 can be opposed to the joint portion 39 of the terminal 30 arranged on the terminal base 47. The lower die 85 has a cavity 85*a* into which the joint portion 39 can enter. The cavity 85*a* can align with the joint portion 39.

The air cylinder 86 has a cylinder main body 86*a* and an extendable rod 86*b* extended from the cylinder main body 86*a*. The cylinder main body 86*a* is fixed to the joint member 81*b* jointing upper ends of the plates 81*a*, 81*a* such that the extendable rod 86*b* extends vertically. The extendable rod 86*b* is joined to the die holder 87.

The die holder 87 is located between the plates 81*a*, 81*a* under the air cylinder 86 such that the die holder 87 is movable vertically parallel to the longitudinal directions of the plates 81*a*, 81*a*. The die holder 87 moves downward with the extension of the extendable rod 86*b* of the air cylinder 86.

The upper die 88 is fitted on an lower end portion of the die holder 84 such that the upper die 88 can be opposed to the joint portion 39 of the terminal 30 disposed on the terminal base 47. The upper die 88 is formed in a blade insertable into the cavity 85*a*. The upper die 88 and the lower die 85 pinch a part of the joint portion 39 at the cavity 85*a* to cut away the part from the connection wall 35*a*.

As illustrated in FIG. 8, the removing piece discharge means 89 has a through hole 89*a* opened to the cavity 85*a*, a discharge pipe 89*b*, and a suction means connected to the discharge pipe. The removing piece discharge means 89 removes the cut-away part of the connection wall 35*a* from a space between the dies 88, 85 through the though hole 89*a* and the discharge pipe 89*b*.

Thus configured carrier cutting unit 54 cuts away the joint portion 39 from the connection wall for ones of the terminals 30 which are required for isolation thereof, while the terminals 30 are held by the carry holder 49*c* of the transfer unit 53. Furthermore, the cutting unit 54 can cut away the joint portion 39 jointing the terminals 30 of the jointed terminal assembly 20 to obtain the terminals 30 required for one of the terminal housing 40.

First, between the lower die 85 and the upper die 88, the transfer unit 53 locates the most downstream one of the joint portions 39 jointing the terminals 30 planed to be isolated from each other.

Figure 22A:
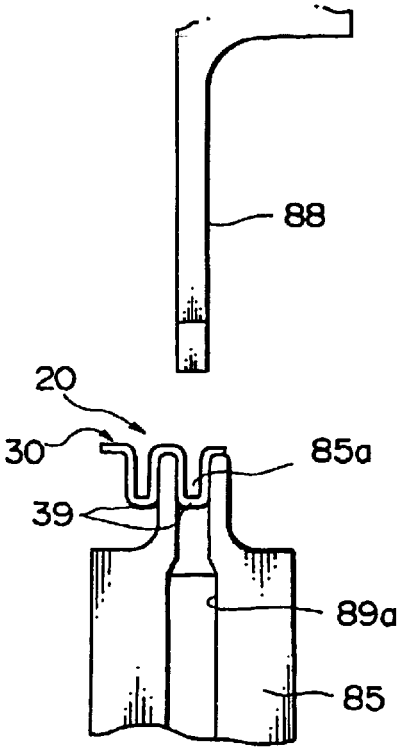
FIGS. 22A and 22B are views showing steps in which the carrier cutting unit of FIG. 7 removes a joint portion.

Then, the extendable rods 82*b*, 86*b* of the air cylinders 82,86 extend as illustrated in FIG. 22A so that the joint portion 39 enters the cavity 85*a* to be positioned therein. And, the upper die 88 moves into the cavity 85*a* having the joint portion 39.

Figure 22B:
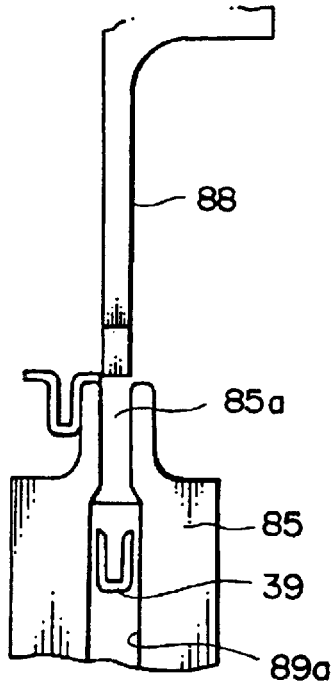

As illustrated in FIG. 22B, the joint portion 39 disposed between the lower die 85 and the upper die 88 is cut away from the connection wall 35*a*. The cut-away joint portion 39 is removed from a space between the dies 85, 88 through the removing piece discharge means 89. Similarly, the transfer unit 53 disposes another joint portion 39, which is planed to be removed, between the dies 85, 88 sequentially from an upstream side.

The tab bending unit 55 is arranged near the terminal feed route 58 in a downstream side of the carrier cutting unit 54. As illustrated in FIGS. 9 to 12, the tab bending unit 55 has a movable die unit 91, an opposed die unit, and a terminal supporting unit 93. The movable die unit 91 and the opposed die unit are arranged such that the terminal base 47 longitudinally extends therebetween.

The movable die unit 91 has an air cylinder 91*a*, a block 91*b*, and a pressing die 91*c*. The air cylinder 91*a* has a cylinder main body 91*d* fixed on the bed 60 and an extendable rod 91*e* extended from the cylinder main body 91*d*. The extendable rod 91*e* can move to come close to and away from the terminal base 47.

The slide block 91*b* is supported on the bed 60 with being movable toward and away from the terminal base 47. The pressing die 91*c* is fitted on an end of the slide block 91*b* to be opposed to the terminal base 47. Thereby, the pressing die 91*c* can oppose to the electrical contact portion 32 of the terminal 30 disposed on the terminal base 47.

The pressing die 91*c* has a blade extended from the slide block 91*b* toward the terminal base 47. The blade can enter between the side walls 35*b*, 35*b* of the terminals 30. The pressing die 91*c* has a vertical width which is sufficiently larger than the height of the side wall 35*b* of the terminal 30. As best shown in FIG. 9, the pressing die 91*c* has a first pressing surface 91*f* and a second pressing surface 91*g* at an end opposed to the terminal 30.

The first pressing surface 91*f* extends along an intermediate plate portion 37*a* (best shown in FIG. 29) between the contact tab 37 and the connection wall 35*a*. The first pressing surface 91*f* is downwardly inclined toward the terminal base 47, that is, toward the terminal 30. The second pressing surface 91*g* is disposed under the first pressing surface 91*f*. The second pressing surface 91*g* extends along the contact tab 37 which is in a connection state.

The opposed die unit has a base 92*a* slidingly attached on the bed 60, a first air cylinder 94*a*, a first slide block 94*b*, a first die 94*c*, a second air cylinder 95*a*, a second slide block 95*b*, and a second die 95*c*.

The base 92*a* slides along a plurality of linear guides 96 in a transfer direction of the terminal feed route 58. The base 92*a* slides in the transfer direction of the terminal feed route 58 by the air cylinder 97 having the cylinder main body 97*a* fixed on the bed 60.

The air cylinder 97 has an extendable rod 97*b* extended from the cylinder main body 97*a*. The extendable rod 97*b* is joined to the base 92*a*. The extension and retraction of the extendable rod 97*b* relative to the cylinder main body 97*a* sides the base 92*a* parallel to the transfer direction of the terminal feed route 58.

The first air cylinder 94*a* has a cylinder main body 94*d* fixed on the base 92*a* and an extendable rod 94*e* extended from the cylinder main body 94*d*. The extendable rod 94*e* moves toward and away from the terminal base 47.

The first slide block 94*b* is arranged to slide on the base 92*a* to move toward and away from the terminal base 47. The first slide block 94*b* is positioned between the cylinder main body 94*d* and the terminal base 47. The first slide block 94*b* is joined to an end of the extendable rod 94*e*. The first slide block 94*b* comes toward and away from the terminal base 47 with the extension and retraction of the extendable rod 94*e*.

The first die 94*c* is fitted an end portion of the first slide block 94*b* to face the terminal base 47. The first die 94*c* has a blade extended from the first slide block 94 toward the terminal base 47. The blade is insertable between the side walls 35*b*, 35*b* of the terminals 30. With the extension of the extendable rod 94*e*, the first die 94*c* moves from an end near the cable connection portion 31 from the electrical contact portion 32 of the terminal 30.

Figure 11:
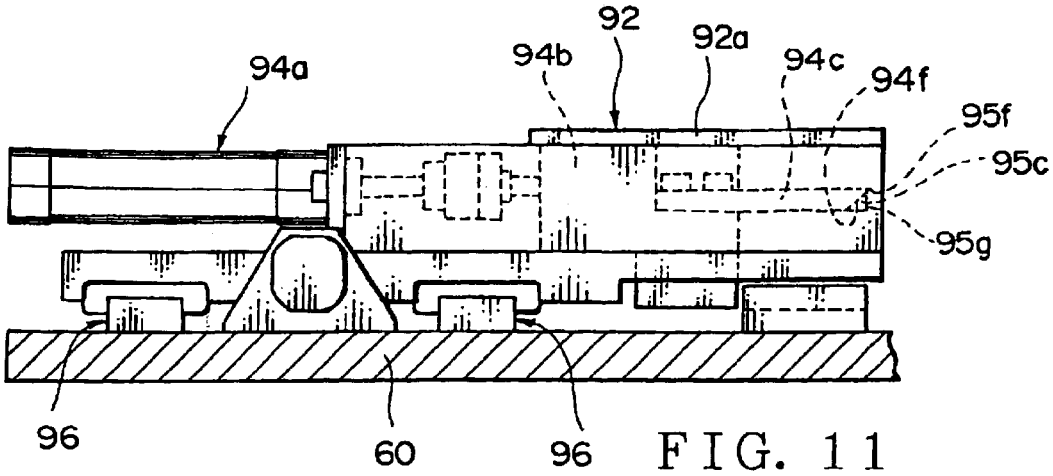
FIG. 11 is a side view showing the tab bending unit of FIG. 9.

The first die 94*c* has a vertical width which is sufficiently larger than the height of the side wall 35*b* of the terminal 30. As best shown in FIG. 11, the first die 94*c* has an inclined surface 94*f* at an end opposed to the terminal base 47, that is, to the terminal 30.

The inclined surface 94*f* is inclined upward toward the terminal base 47, that is, toward the terminal 30. Thus, the inclined surface 94 comes close to the connection wall 35*a* of the terminal 30 when the first die 94*c* moves toward the terminal 30 disposed on the terminal base 47.

The second air cylinder 95*a* has a cylinder main body 95*d* fixed on the base 92*a* and an extendable rod 95*e* extended from the cylinder main body 95*d*. The extendable rod 95*e* moves to come toward and away from the terminal base 47.

The second slide block 95*b* is slidingly supported on the base 92*a* and moves to come toward and awry from the terminal base 47. The second slide block 95*b* is positioned between the cylinder main body 95*d* and the terminal base 47. The second slide block 95*b* is joined to an end of the extendable rod 95*e*. The second slide block 95*b* moves toward and away from the terminal base 47 with the extension and retraction of the extendable rod 95*e*.

The second die 95*c* is fitted on an end portion of the second slide block 95*b* near the terminal base 47. With the extension of the extendable rod 95, the second die 95*c* moves from an end near the cable connection portion 31 toward the electrical contact portion 32 of the terminal 30.

The second die 95*c* has a blade extended from the second slide block 95*b* toward the terminal base 47. The blade is insertable between the side walls 35*b* of the terminals 30.

The second die 95*c* has a vertical width which is sufficiently larger than the height of the side wall 35*b* of the terminal 30. The second die 95*c* has a first forming surface 95*f* and a second forming surface 95*g* at an end opposed to the terminal base 47, that is, to the terminal 30 as best shown in FIG. 24.

The first forming surface 95*f* can abut against the intermediate plate portion 37*a*. The first forming surface 95*f* is opposed to the first pressing surface 91*f*. The first forming surface 95*f* is inclined the terminal base 47, that is, toward the terminal 30. The second forming surface 95*g* is positioned in an under side of the first forming surface 95*f*. The second forming surface 95*g* is fit with the contact tab 37 which is in a connection state. The second forming surface 95*g* is opposed to the second pressing surface 91*g*.

As illustrated in FIGS. 9 to 12, the terminal supporting unit 93 is positioned in an under side of the bed 60. The terminal supporting unit 93 has a unit main body 93*a*, an air cylinder 98, and a support block 99. The unit main body 93*a* is fixed to an edge of the through hole 67*a* in the under side of the bed 60.

The air cylinder 98 has a cylinder main body 98*a* fixed to the unit main body 93*a* and an extendable rod 98*b* extended from the cylinder main body 98*a*. The extendable rod 98*b* extends upward.

The support block 99 vertically moves relative to the unit main body 93*a*. The support block 99 can extend near the upper surface 47*a* of the terminal base 47 through the hole 67*a* and the opening 47*b*. When the extendable rod 98*b* of the air cylinder 98 extends, the support block 99 becomes substantially flush with the upper surface 47*a* of the terminal base 47 in the opening 71*b*.

In the tab bending unit 55, the terminals 30 of which the predetermined joint portions 39 have been removed are supplied by the carry holder 49*c* of the transfer unit 53. Meanwhile, for the terminals 30 of which the contact tabs 37 are desired to be in a connection state, the contact tabs 37 are brought into the connection state sequentially from the most downstream one of the terminals 30. The terminals 30 are brought into a connection state through the following steps.

First, the contact tab 37 of the electrical contact portion 32 of the terminal 30, which is desired to be in a connection state, is disposed to be opposed to the pressing die 91*c*. Furthermore, the cable connection portion 31 of the terminal 30 is disposed to be opposed to the first die 94*c*. In this state, the extendable rod 98*b* of the terminal supporting unit 93 is extended from the air cylinder 98, and the terminal 30 is supported on the support block 99. The extendable rod 97*b* of the air cylinder 97 is also extended.

Next, the extendable rods 91*e*, 94*e* of the air cylinders 91*a*, 94*a* are extended. Thereby, the first die 94*c* moves toward the electrical contact portion 32, and the pressing die 91*c* moves toward the cable connection portion 31. The first die 94*c* and the pressing die 91*c* enter between the side walls 35*b*, 35*b*.

Figure 23A:
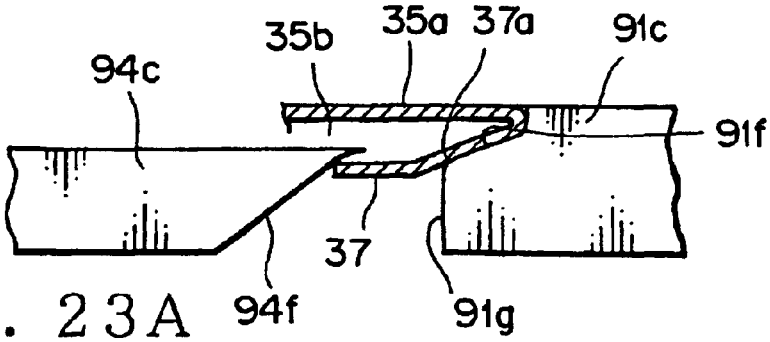
FIGS. 23A and 23B are views showing steps in which a first die of the tab bending unit of FIG. 9 deforms a contact tab.
Figure 23B:
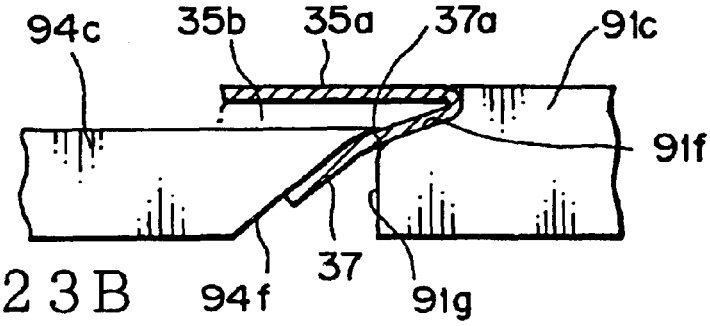

As illustrated in FIG. 23A, the inclined surface 94*f* of the first die 94*c* contacts the contact tab 37 which is in an isolation state. As illustrated in FIG. 23B, the contact tab 37 is pinched between the inclined surface 94*f* of the first die 94*c* and the first pressing surface 91*f* of the pressing die 91*c* to be deformed into a connection state. At that time, the air cylinder 98 of the terminal supporting unit 93 extracts the extendable rod 98*b*, while the dies 91*c*, 94*c* enter the side walls 35*b*. Thereby, the support block 99 is moved downward thorough the opening 47*b*.

Then, the extendable rods 91*e*, 94*e* of the air cylinders 91*a*, 94*a* are moved backward, and the extendable rod 98*b* of the air cylinder 98 of the terminal supporting unit 93 is extended, so that the support block 99 retains the terminal 30.

Next, the extendable rod 97*b* of the air cylinder 97 is retracted so that the cable connection portion 31 of the terminal 30 is opposed to the second die 95*c*. Then, the extendable rods 91*e*, 95*e* of the air cylinders 91*a*, 95*a* are extended.

Figure 24A:
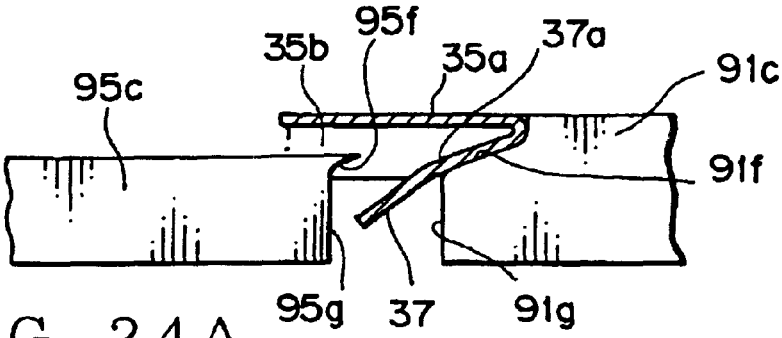
FIGS. 24A and 24B are views showing steps in which a second die of the tab bending unit of FIG. 9 deforms a contact tab.

Thus, the second die 95*c* and the pressing die 91*c* enter between the sides wall 35*b*, 35*b*. Thereby, as illustrated in FIG. 24A, the second forming surface 95*g* of the second die 95*c* contacts the contact tab 37 which is in a provisional isolation state.

Figure 24B:
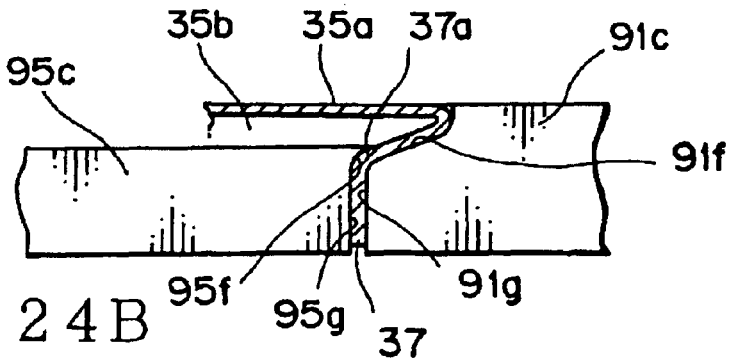

As illustrated in FIG. 24B, the contact tab 37 is pinched between the first forming surface 95*f* and the first pressing surface 91*f* and also between the second forming surface 95*g* and the second pressing surface 91*g* to be deformed into the connection state.

At this stage, the air cylinder 98 of the terminal supporting unit 93 retracts the extendable rod 98*b* to move the support block 99 downward through the opening 47*b*, while the dies 91*c*, 95*c* enter between the side walls 35*b*.

Next, the extendable rods 91*e*, 95*e* of the air cylinders 91*a*, 95*a* are moved backward, and the extendable rod 98*b* of the air cylinder 98 of the terminal supporting unit 93 is extended, so that the support block 99 retains the terminal 30. Thereafter, the contact tab 37 of the terminal 30, which is desired to be in a connection state, is deformed according to the steps described above.

The separator 56, which is a terminal aligning unit, is in a downstream side of the tab bending unit 55 near the terminal feed route 58. As illustrated in FIGS. 13 to 16, the separator 56 has a unit main body 101, a plurality of air cylinders 102, and a plurality of extendable members 103.

The unit main body 101 is elongated vertically and is fixed to an edge of the through hole 67*b* at one end side portion of the body. The unit main body 101 has a projected plate 101*a* upwardly projected above the bed 60, The projected plate 101*a* is positioned in the opening portion 47*c* of the terminal base 47. The projected plate 101*a* has a plurality of through holes 101*b* parallel disposed along the transfer direction of the terminal 30.

Each through hole 101*b* vertically penetrates through the projected plate 101*a*. There are provided ten of the through holes 101*b*. Each through hole 101*b* can be opposed to the press-fit portion 31*a* of the terminal 30 supplied along the terminal feed route 58. The through hole 101*b* has a width along the transfer direction of the terminal feed route 58, which is substantially equal to the distance between the side walls 35*b*, 35*b* of the terminal 30.

There are provided ten sets of the air cylinders 102 and the extendable members 103. Each air cylinder 102 has a cylinder main body 102*a* and an extendable rod 102*b* extended from the cylinder main body 102*a*. The cylinder main body 102*a* is fixed to the unit main body 101 such that the extendable rod 102*b* extends upward.

The extendable member 103 is generally a flat bar and is movably inserted vertically into the through hole 101*b*. The extendable member 103 has a thickness substantially equal to the distance between the side walls of the terminal 30. Each extendable member 103 is coupled to the extendable rod 102*b* via a link member 104.

Figure 15:
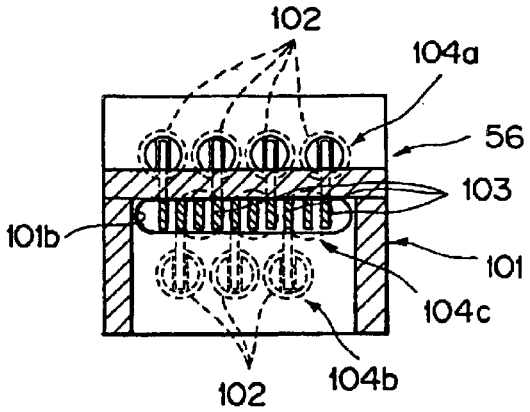
FIG. 15 is a sectional view taken along line XV-XV of FIG. 13.
Figure 16:
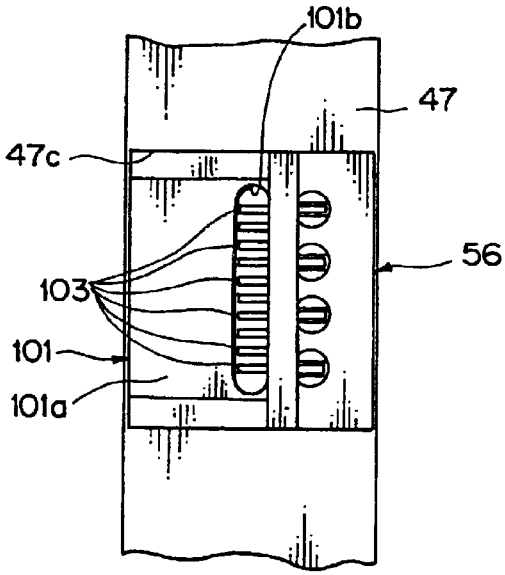
FIG. 16 is a view taken along an arrow XVI of FIG. 14 for showing the separator of FIG. 13.
Figure 13:
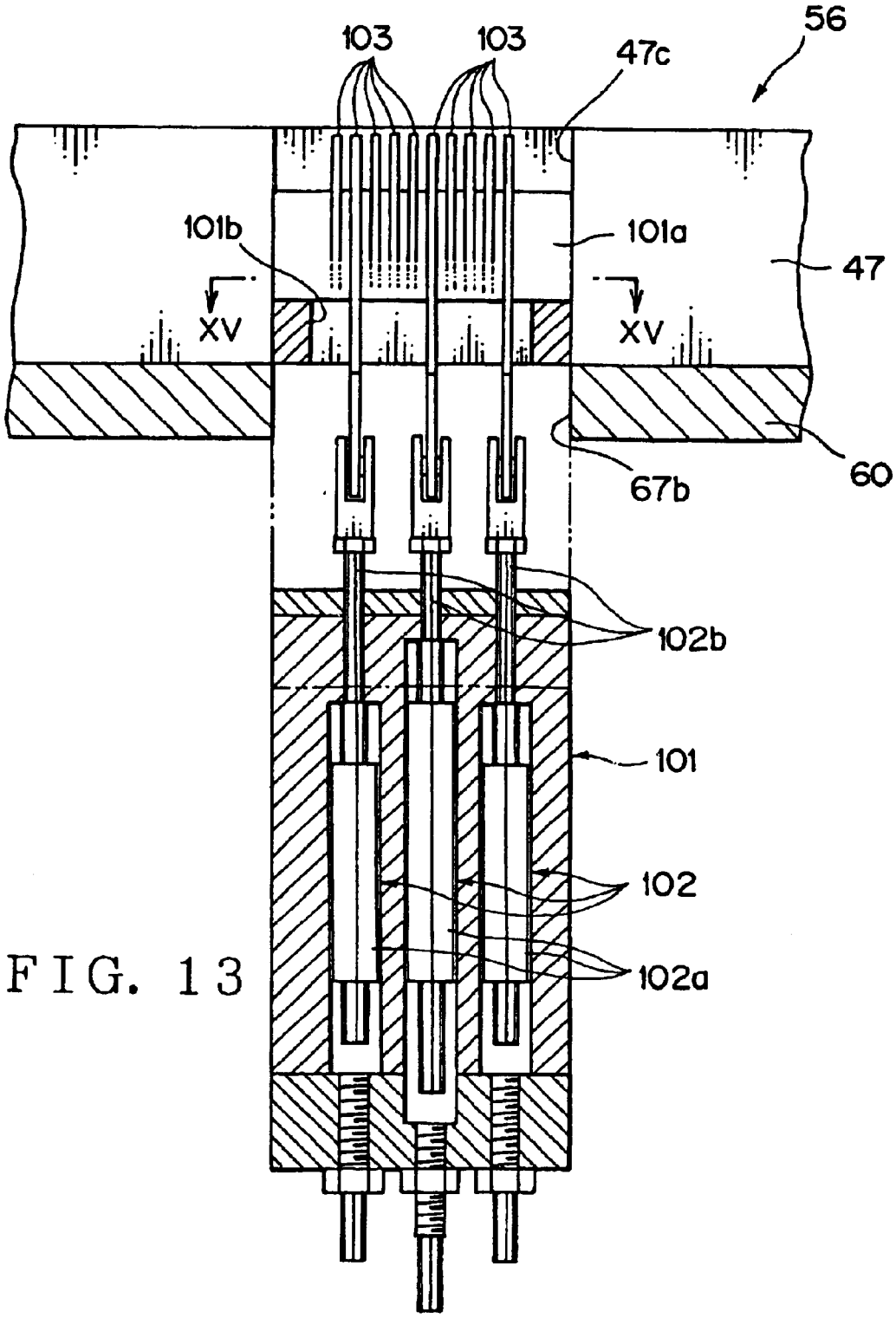
FIG. 13 is a partial sectional view taken along the arrow S1 of FIG. 2 for showing a separator of the terminal mounting apparatus of the embodiment.

The cylinder main body 102*a* has a thickness larger than that of the extendable member 103. Thus, as illustrated in FIG. 15, first and second rows 104*a*, 104*b* of the air cylinders 102 are disposed to position the through hole 101*b* therebetween in a direction crossing the transfer direction of the terminal feed route 58. Furthermore, a third row 104*c* of the air cylinders 102 are disposed under the through hole 101*b* in parallel to the first and second rows.

The most upstream one of the extendable members 103 is associated with one of the first row 104*a* of air cylinders 102. Another extendable member 10 adjacent to the most upstream one is associated with one of the third row 104*c* of the air cylinders 102. Further another extendable member 103 adjacent to the another member 103 is associated with one of the second row 104*b* of air cylinders 102.

That is, downstream in the terminal transfer direction, the extendable members 103 are sequentially associated with the first row 104*a*, the third row 104*c*, and the second row 104*b* of the air cylinders 102. Another extendable member 103 next to the member 103 associated with the second row 104*b* of air cylinders 102 is associated with the first row 104*c* of the air cylinders 102. Thus, the extendable members 103 are extended from the air cylinders 102 positioned in a staggered pattern downstream in the terminal transfer direction.

Thus configured separator 56, as described hereinafter, cooperates with the carry holder 49*c* to adjust the spaces between the terminals 30 required for one of the terminal housings 40 to fit with the spaces between the terminal insertion channels 41.

Figure 25A:
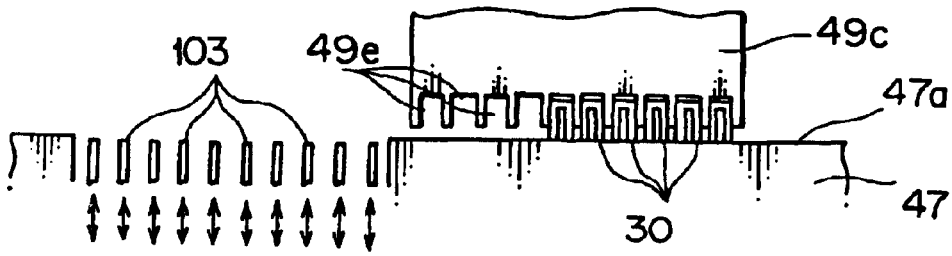
FIGS. 25A to 25F are view showing steps in which the separator of FIG. 13 adjusts spaces between the terminals.

First, the pre-formed press-fit terminals 30 are transferred on the upper surface 47*a* of the terminal base 47 from the tab bending unit 55*a* as illustrated in FIG. 25A. The drawing shows an example in which only five of ten terminal insertion channels 41 each receive the terminal 30. Thus, the carry holder 49*c* holds the terminals 30 in five of the spaces 49*e* positioned in the upstream side.

Figure 25B:
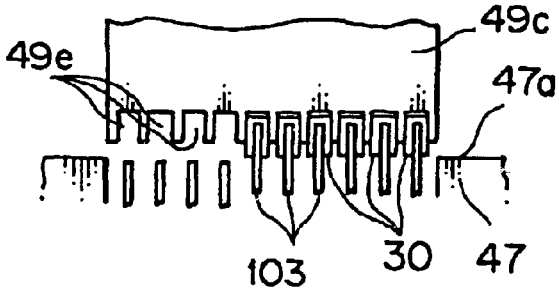

Toward the terminals 30 which are transferred above the opening portion 47*c*, as illustrated in FIG. 25B the same number of the extendable rods 102*b* of the air cylinder 102 as the number of the terminals 30 held by the carry holder 49*c* are extended. In the illustrated example, upstream five of ten extendable rods 102*b* of the air cylinders 102 is extended. The upstream five of extendable members 103 enter between the side walls 35*b*, 35*b* to correct position the terminals 30 on the terminal base 47.

The carry holder 49*c* is moved upward apart from the terminal base 47. The extendable members 103, which have positioned the terminals 30 corresponding to the desired terminal insertion channels 41 sequentially from the upstream side, each keep a position projected above the upper surface 47*a* of the terminal base 47.

All the extendable members 103, which are positioned downstream from one extendable members 103 not positioned to be inserted into the desired terminal insertion channel 41, are moved under the upper surface 47*a*. Thereby, the extendable members 103, which have moved downward, disengage from the terminals 30.

Figure 25C:
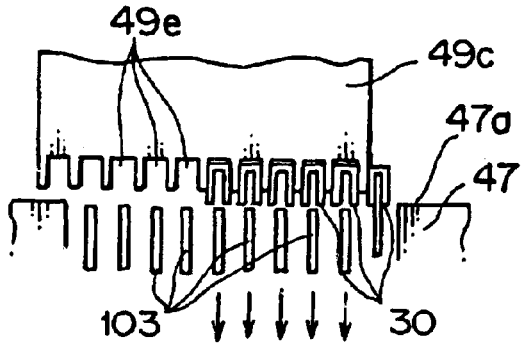

Next, as illustrated in FIG. 25C, the most upstream one of the terminals 30 which have disengaged from the extendable members 103 aligns with the most upstream space 49*e* of the carry holder 49*c*. The carry holder 49*c* moves downward again to hold all the disengaged press-fit terminals 30.

That is, the carry holder 49*c* moves upward, and the carry holder 49*c* slides downstream to align the most upstream space 49*c* with the most upstream extendable member 10 which has disengaged from the terminal 30.

The carry holder 49*c* slides downstream until the most upstream one of press-fit terminals 30 which have been held in the spaces 49*c* to reach a position corresponding to the terminal insertion channel 41 planed to receive the terminal 30.

Figure 25D:
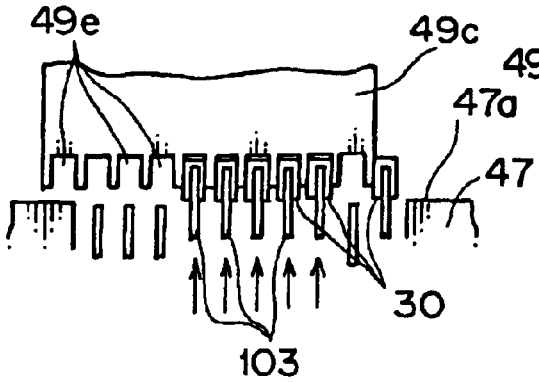

When the most upstream one of press-fit terminals 30 which have been held in the spaces 49*c* reaches a position corresponding to one of the desired terminal insertion channels 41, the extendable members 103 are moved upward above the upper surface 47*a* to enter between the side walls 35*b* as illustrated in FIG. 25D. Thus, the extendable members 103 position the terminals 30 again and the carry holder 49*c* is moved upward as illustrated in FIG. 25E.

In the state illustrated in FIG. 25D, when there is another press-fit terminal 30 which is not positioned to align with one of the desired terminal insertion channels 41, all the extendable members 103, which are positioned downstream of the most upstream one of the extendable members 103 corresponding to the terminal insertion channels 41 which will not receive the terminal 30, are moved downward under the upper surface 47*a*.

The carry holder 49*c* transfers downstream again the terminals 30 which have been disengaged from the extendable members 103, until one of the terminals 30 reaches a position to align with a desired one of the terminal insertion channels 41. Again, the extendable members 103 move upward above the upper surface 47*a* to position the terminals 30. These positioning operations are repeated until all the terminals 30 are positioned to align with the terminal insertion channels 41 predetermined to receive the terminals 30.

Figure 25E:
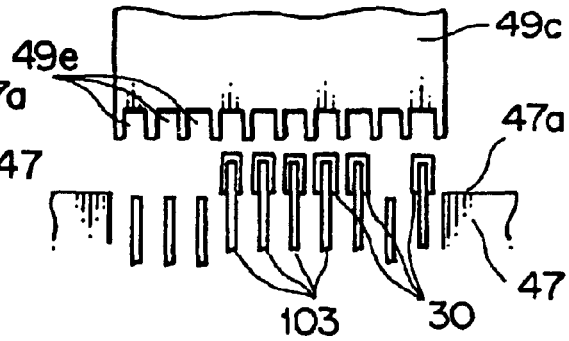
Figure 25F:
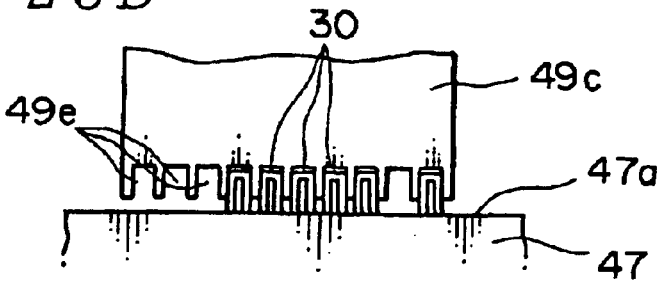

When all the terminals 30 are positioned to align with the terminal insertion channels 41 planed to receive the terminals 30, the terminals 30 engages with the extendable members 103 for the positioning thereof as illustrated in FIG. 25E. Then, the carry holder 49*c* slides horizontally so that each space 49*c* aligns with each extendable member 103. Thereafter, the carry holder 49*c* moves downward to hold the terminals 30 between the spaces 49*e*. As illustrated in FIG. 25F, the carry holder 49*c* transfers downstream the terminals 30 on the upper surface 47*a* of the terminal base 47.

The insertion unit 57 is located downstream of the separator 56 near the terminal feed route 58. The insertion unit 57 is opposed to the housing feed route 59 with the terminal feed route 58 being positioned therebetween.

Figure 17:
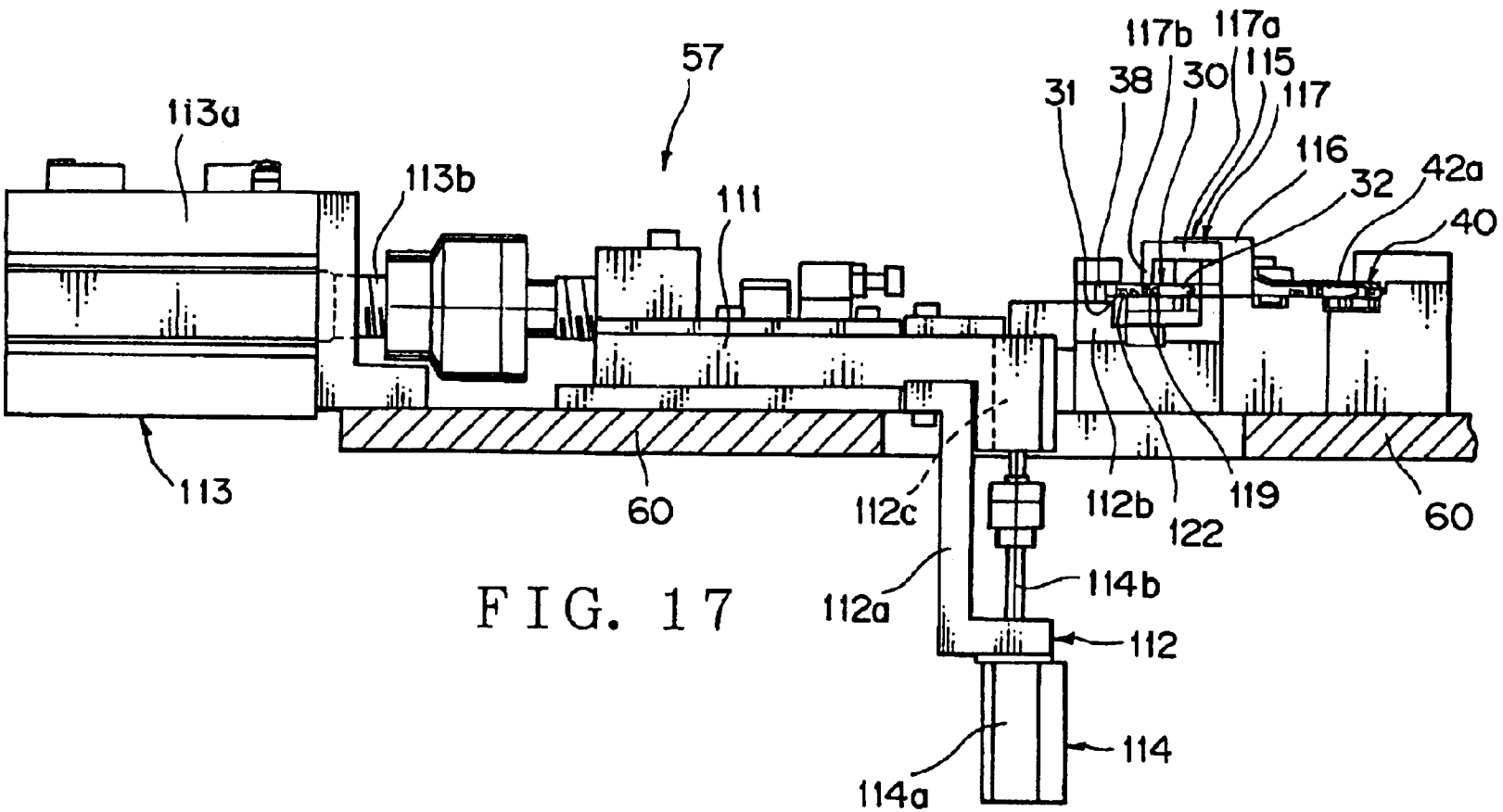
FIG. 17 is a view taken along the arrow S2 of FIG. 2 for showing an insertion unit of the terminal mounting apparatus of the embodiment.
Figure 18:
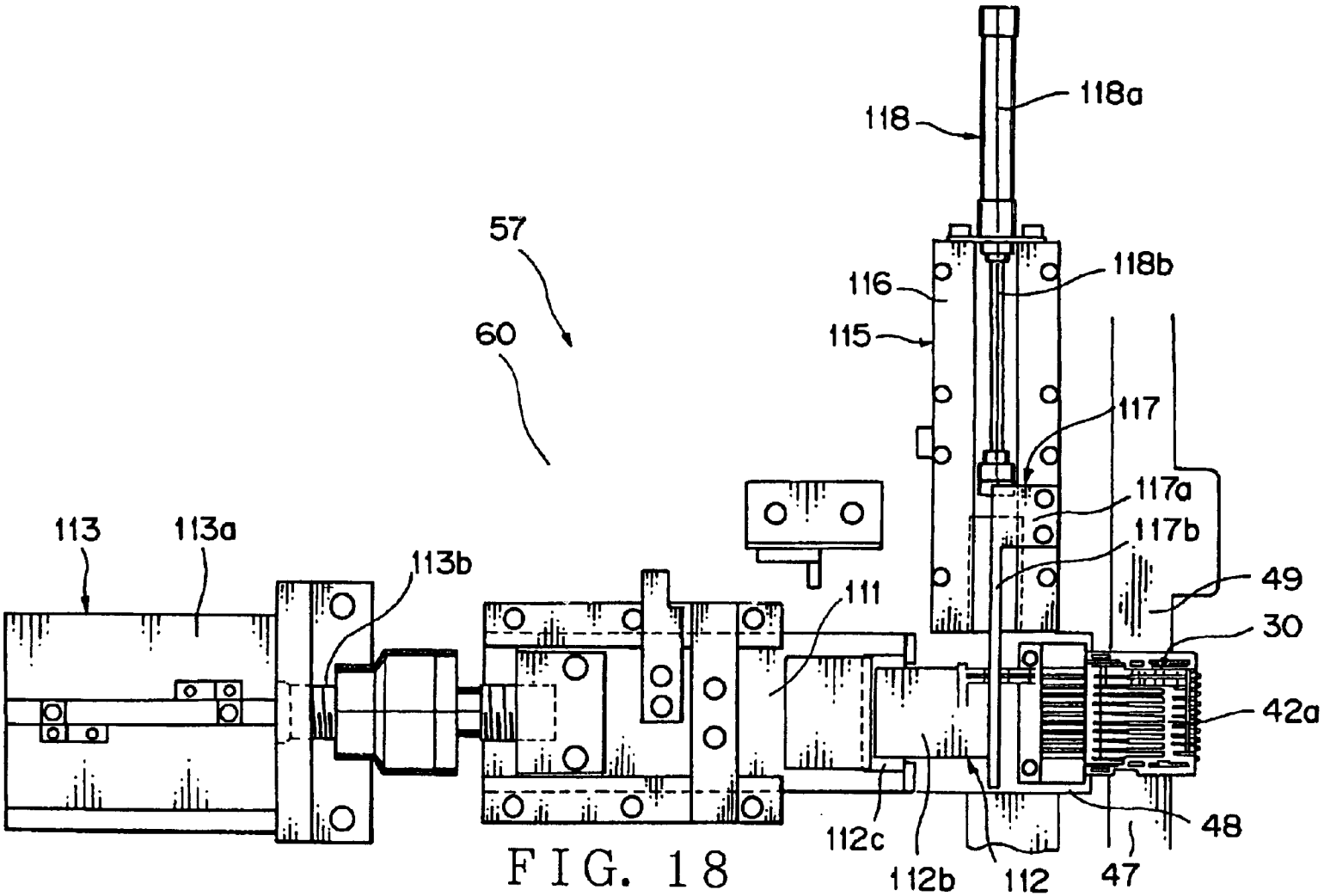
FIG. 18 is a plan view for showing the insertion unit of FIG. 17.
Figure 19A:
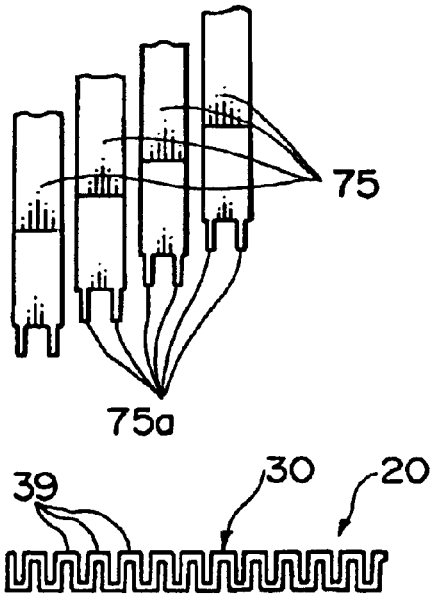
FIGS. 19A to 19E are illustrations showing steps for adjusting spaces between press-fit terminals by means of terminal clamps of the terminal positioning unit of FIG. 3.
Figure 19B:
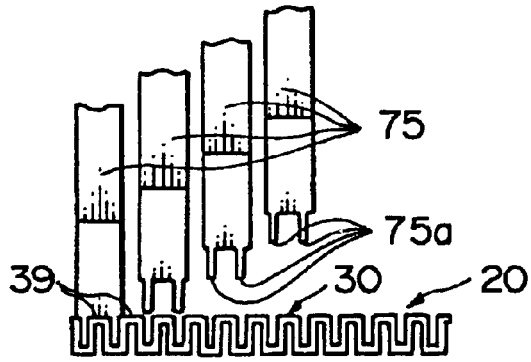
Figure 19C:
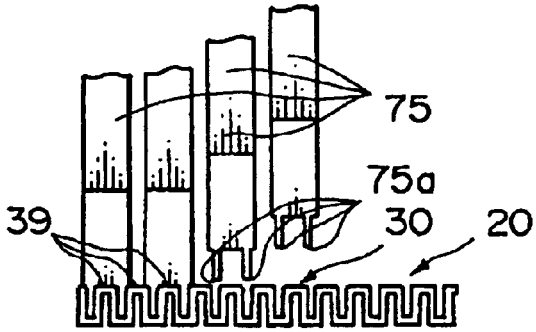
Figure 19D:
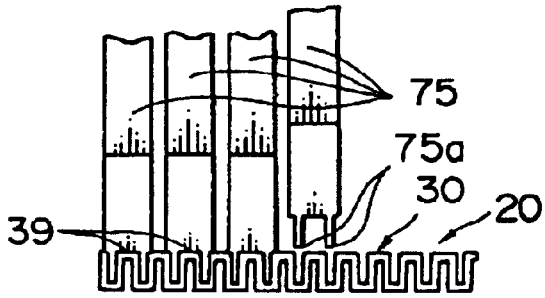
Figure 19E:
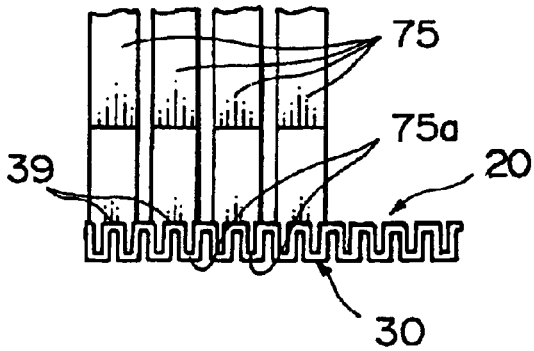

As illustrated in FIGS. 17 and 18, the insertion unit 57 has a unit main body 111, a terminal supporting unit 112, a pressing unit 115, and a terminal actuator cylinder 113 which is a moving means. The unit main body 111 is opposed to the housing feed route 59 with the terminal feed route 58 being located therebetween. The unit main body 111 is slidingly disposed on the bed 60 to come close to and apart from the terminal feed route 58.

The terminal supporting unit 112 has a frame 112*a*, an air cylinder 114, a slide block 112*c*, and a terminal supporting die 112*b* which is an insertion member. The frame 112*a* is fitted on an under surface of unit main body 111. The frame 112*a* extends downward from the unit main body 111.

The air cylinder 114 has a cylinder main body 114*a* and a cylinder rod 114*b* extendable from cylinder main body 114*a*. The cylinder main body 114*a* is fixed to the frame 112*a* such that the cylinder rod 114*b* can move upward.

The slide block 112*c* is provided in the unit main body 111 to vertically move therein. The slide block 112*c* is coupled to an end of the extendable rod 114*b*. The slide block 112*c* moves vertically with the extension and contraction of the extendable rod 114*b*.

The terminal supporting die 112*b* is joined to an end of the slide block 112*c* near the terminal feed route 58. Thus, the terminal supporting die 112*b* moves vertically with the extension and retraction of the extendable rod 114*b*.

The terminal supporting die 112*b* has a projection 122 (best shown in FIG. 26). The projection 122 enters the cutout 38 of each of press-fit terminals 30 required for one terminal housing 40 and supplied through the separator 56 when the extendable rod 114*b* is extended to move upward.

The upper pressing unit 115 is disposed along the terminal feed route 58 to be opposed to an end of the terminal base 47. The upper pressing unit 115 has a unit main body 116, an air cylinder 118, and an upper pressing block 117. The unit main body 116 is fixed on the bed 60.

The air cylinder 118 has a cylinder main body 118*a* and an extendable rod 118*b* extended from the cylinder main body 118*a*. The cylinder main body 118*a* is fitted to the unit main body 116 such that the extendable rod 118*b* can be extendable toward an upstream side of the terminal transfer.

An upper pressing block 117 is joined to an end of the extendable rod 118*b*. The upper pressing block 117 has a slide support 117*a* and a pressing blade 117*b*. The slide support 117*a* is slidingly supported on the unit main body 116 along the terminal transfer direction. The pressing blade 117*b* is extended from the slide support 117*a* toward an upstream side of the terminal transfer.

The pressing blade 117*b* has an abutting surface 119 downwardly contacting the terminal 30 disposed on the upper surface 47*a* of the upper surface 47*a*. The abutting surface 119 is substantially flat. The upper pressing block 117 slides along the terminal transfer direction with the extension and retraction of the extendable rod 118*b*.

The extension of the extendable rod 118*b* moves the pressing blade 117*b* above the terminal base 47 so that the abutting surface 119 abuts against the terminal 30 as illustrated in FIG. 18.

The actuator cylinder 113 has a cylinder main body 113*a* and an extendable rod 113*b* extended from the cylinder main body 113*a*. The cylinder main body 113*a* is fixed on the bed 60. The extendable rod 113*b* has an end coupled to the unit main body 111. The extension and retraction of the extendable rod 113*b* of the actuator cylinder 113 causes the unit main body 111 of each terminal supporting unit 112 to come toward and apart from the terminal feed route 58.

In thus configured insertion unit 57, the actuating rods of the air cylinder 114 and actuator cylinder 113 are retracted before the terminals 30 required for one terminal housing 40 are supplied therein from the separator 56. Then, the carry holder 49*c* of the transfer unit 53 transfers the terminals 30 required for one terminal housing 40. The carry holder 49*c* moves the terminals 30 upstream on an end portion of the terminal base 47.

Figure 26A:
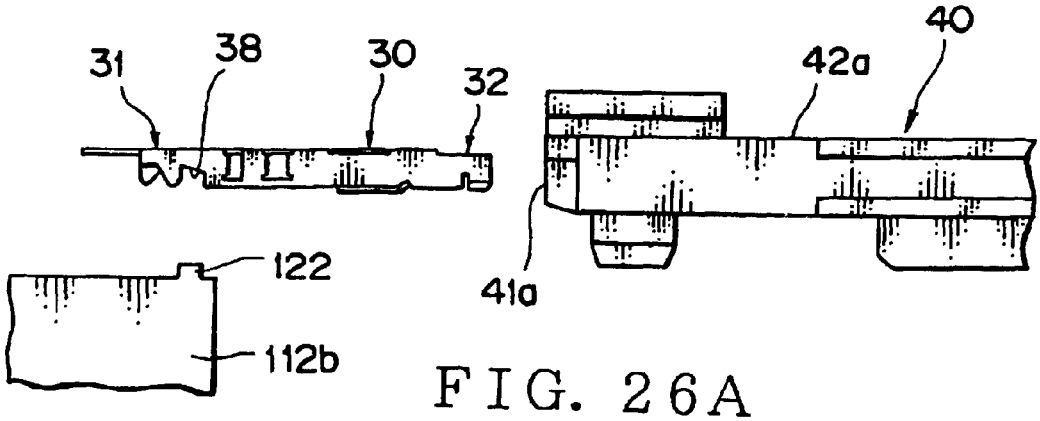
FIGS. 26A to 26C are view showing steps in which the insertion unit of FIG. 17 presses the terminals into the terminal insertion channels of the terminal housing.

Meanwhile, the terminal supporting die 112*b* is spaced from the terminal 30, and the projection 122 is located under the cutout 38 as illustrated in FIG. 26A.

After the carry holder 49*c* puts the terminal 30 on the end portion of the terminal base 47, the extendable rod 118*b* of the air cylinder 118 extends, so that the pressing blade 117*b* moves upward above the terminal base 47. Thereby, the abutting surface 119 contacts the terminal 30.

Figure 26B:
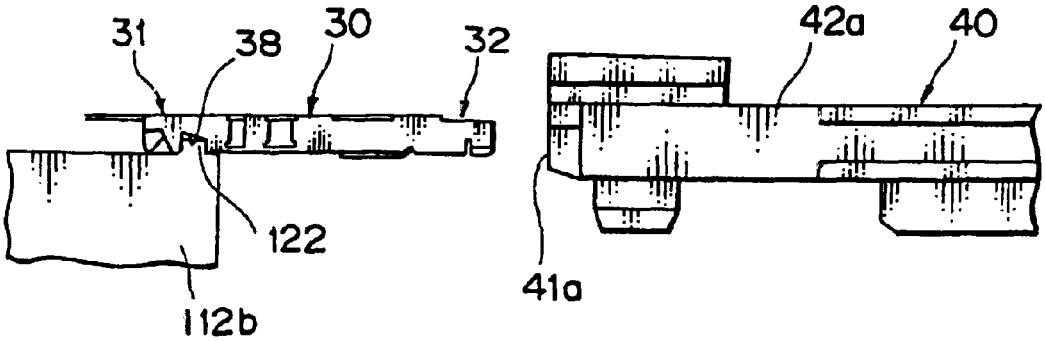

As illustrated in FIG. 26B, the extendable rod 114*b* of the air cylinder 114 extends so that the projection 122 enters the cutout 38. Then, the extendable rod 113*b* of the actuator cylinder 113 extends, so that the terminal supporting die 112*b* of each unit main body 111 comes close to the terminal housing 40.

Figure 26C:
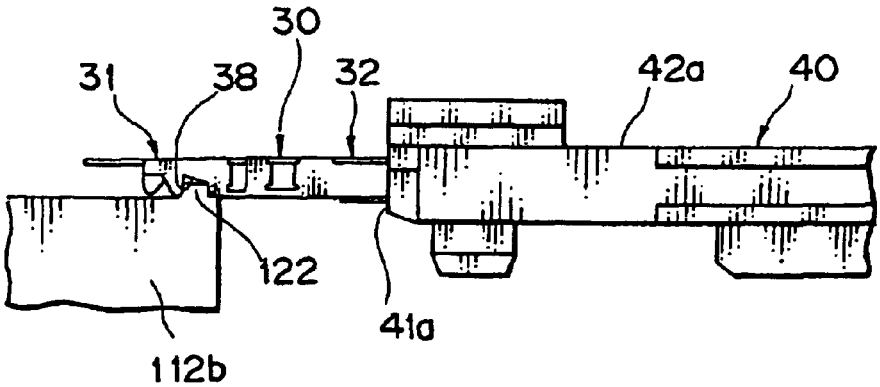

As illustrated in FIG. 26C, the terminals 30 are pressed by the terminal supporting die 112*b*, so that the terminals 30 are inserted all at once into the terminal insertion channels 41 from the end 41*a* of the housing. Note that, when the terminals 30 are pressed into the terminal insertion channels 41, the pressing blade 117*b* downwardly abuts against the terminal 30 to guide the terminal 30 in the insertion direction.

The control unit 120 is a computer having a RAM, a ROM, a CPU, etc. The control unit 120 is connected to the jointed terminal assembly feed unit 51, the terminal positioning unit 52, the transfer unit 53, the carrier cutting unit 54, the tab bending unit 55, the separator 56, the insertion unit 57, etc. The control unit 120 controls the whole of terminal mounting apparatus 1.

The control unit 120 stores preliminarily a plurality of parts numerals of the terminal housings 40 which have received the terminals 30, data of positions of the terminal insertion channels 41 for receiving the terminals 30 having the parts numerals, data of positions where the joint portions 39 should be removed, and data of positions where the contact tabs 37 should be changed to a connection state.

The control unit 120 controls operations of the units 51, 52, 53, 54, 55, 56, and 57 based on information from the input means 121 which determines a plurality of parts numerals of the terminal housings 40 which will be produced and a desired production number thereof.

The input means 121 determines a plurality of parts numerals of the terminal housings 40 and a desired production number thereof. That is, the input means 121 is used for various kinds of operations of the terminal mounting apparatus 1.

The input means 121 may input data of new parts numerals of the terminal housings 40 into the control unit 120. The input means 121 is a known information input device such as a keyboard, various types of switches, and various types of drive devices of record mediums like a CD-ROM.

Next, mainly referring to FIG. 27, steps of inserting the terminals 30 into the terminal housing 40 by using the terminal mounting apparatus 1 will be discussed. First, in step S1 of FIG. 27, the terminal positioning unit 52 adjusts the spaces between the terminals 30 which can be inserted into the terminal insertion channels 41. The terminals 30 are supplied as the jointed terminal assembly 20 from the jointed terminal assembly feed unit 51. After the adjustment, step S2 will be executed.

In step S2, the carry holder 49*c* of the transfer unit 53 holds the terminals. 30 of which the spaces have been adjusted by the step S1, before step S3 is executed. In step S2, the carry holder 49*c* holds the terminals 30 required for one terminal housing 40 in the spaces 49*e* sequentially from an upstream one.

In step S3, the carrier cutting unit 54 removes the joint portion 39 which is predetermined to be isolate the associated press-fit terminals 30. Furthermore, the carrier cutting unit 54 removes the joint portion 39 which joints the most upstream one of the terminals 30 held by the carry holder 49*c* to another press-fit terminal 30 adjacent to the most upstream one.

That is, the terminals 30 held by the carry holder 49*c* are cut away from the jointed terminal assembly 20 before step S4 is executed.

In step S4, the control unit 120 determines whether there is a contact tab 37 planed to be brought into a connection state among the contact tabs 37 of the terminals 30 required for the terminal housing 40 having a parts numeral for production thereof. When there is such a contact tab 37, step S5 is executed. Meanwhile, when there is no such contact tab 37, step S6 is executed.

In step S5, the tab bending unit 55 pinches the contact tab 37 between the first die 94*c* and the pressing die 91*c* and between the second die 95*c* and the pressing die 91*c* to deform it to bring in a connection state. Then step S6 is carried out.

In step S6, the control unit 120 determines whether there is a terminal insertion channel 41 planed not to receive the terminal 30 for the terminal housing 40 having a parts numeral for production thereof. Note that the vacant terminal insertion channel 41 is between the terminal insertion channels 41 each of which is planed to receive the terminal 30. When there is such a vacant terminal insertion channels 41, the terminal housing 40 receives the terminals 30 with an intermediate vacant channel.

When there is such an intermediate vacant terminal insertion channel 41 planed not to receive the terminal 30, step S7 is carried out. When there is no such intermediate vacant terminal insertion channel 41, step S8 is carried out.

In step S7, the separator 56 adjusts the spaces between the terminals 30 which have been held by the carry holder 49*c* to correspond with the spaces between the terminal insertion channels 41 for receiving the terminals 30. Then, step S8 is carried out.

In step S8, the terminals 30 which have been held by the carry holder 49*c* are disposed near the insertion unit 57. Then, the terminals 30 each are guided by the abutting surface 119 of the press blade 117*b* to be pressed into the terminal insertion channels 41 all at once. Then, the terminal housing 40 which has received the terminals 30 as intended are transferred to a downstream side of the housing feed route 59.

In the terminal mounting apparatus 1 of the embodiment, the carry holder 49*c* holds a required number of press-fit terminals 30 for one terminal housing 40, and the terminals 30 held by the carry holder 49*c* are inserted all at once into the terminal insertion channels 41 of the terminal housing 40. Thus, the terminals 30 are reliably inserted into the terminal housing 40.

Since the terminals 30 held by the carry holder 49*c* are inserted all at once into the terminal insertion channels 41 of the terminal housing 40, a reduced time is required for inserting the terminals 30 into the terminal housing 40.

Furthermore, before the carry holder 49*c* holds the terminals 30 to transfer them, the terminal positioning unit 52 adjusts the spaces between the terminals 30. The terminal positioning unit 52 pinches an end of the cable connection portion 31 of the terminal 30 between the tabs 75*a* of the terminal clamp 75, and the peak 77*b* of the alignment blade 77 enters between the side walls 35*b*, 35*b*.

Each terminal clamp 75 comes close to and apart from the terminals 30, and the terminal clamps 75 initially have been spaced from the terminals 30, the spaces being gradually smaller downstream in the terminal transfer direction. Thus, when the terminal clamp 75 pinches the cable connection portions 31 between the tabs 75*a*, the cable connection portions 31 of the terminals 30 are pinched sequentially from the most downstream one. Thereby, the spaces between the terminals 30 are surely adjusted.

In addition, the required number of the terminals 30 for one terminal housing 40 can be reliably held and can be inserted into the terminal insertion channels 41 all at once.

The carrier cutting unit 54 pinches the joint portion 39 between the upper die 88 and the lower die 85 to remove the joint portion 39 to isolate the adjacent press-fit terminals 30 which have been connected by the joint portion 39 in the terminal housing 40. Thus, the terminals 30 required for one terminal housing 40 are reliably inserted into the terminal housing 40, and the terminals 30 can include mutually connected ones and mutually isolated ones.

The tab bending unit 55 deforms the contact tab 37 to bring it to connect to a second press-fit terminal 30 mounted in a second terminal housing 40 when a plurality of terminal housings 40 are layered.

Thus, the terminals 30 required for one terminal housing 40 are reliably inserted into the terminal housing 40, and the terminals 30 includes one which will be connected to a second press-fit terminal 30 of a second terminal housing 40 and one which will be isolated from a second press-fit terminal 30 of a second terminal housing 40.

The tab bending unit 55 has the first die 94*c* and the second die 95*c*. The first die 94*c* has the inclined surface 94*f* positioned to gradually close to the connection wall 35*a* of the terminal 30. The second die 95*c* has the second forming surface 95*g* along the contact tab 37 which is in a connection state. Thus, the tab bending unit 55 surely deforms the contact tab 37 to change it from an isolation state into an connection state.

The separator 56 adjusts the spaces between the terminals 30 to correspond to the spaces between the terminal insertion channels 41. That is, even when there is one of the terminal insertion channels 41 planed not to receive the terminal 30 between the terminal insertion channels 41 planed to receive the terminals 30, the spaces between the terminals 30 are adjusted to correspond to the spaces between the terminal insertion channels 41 planed to receive the terminals 30. Thus, even when there is the terminal insertion channels 41 planed not to receive the terminal 30, the terminals 30 required for one terminal housing 40 are inserted into the terminal housing 40 all at once.

In the separator 56, the extendable members 103 do not position the terminals 30 which are located downstream from one of the terminals 30 which is disposed to align with one of the terminal insertion channels 41 planed not to receive the terminals 30. Meanwhile, the extendable member 103 positions the terminals 30 which are located upstream from the most upstream press-fit terminal 30 which is disposed to align with one of the terminal insertion channels 41 planed not to receive the terminals 30.

The carry holder 49*c* transfers the terminals 30, which have not been positioned by the extendable member 103, to locate the terminals 30 to correspond to the terminal insertion channels 41 planed to receive the terminals 30. Thus transferred press-fit terminals 30 are positioned by the extendable members 103. Thus, the spaces between the terminals 30 required for one terminal housing 40 are adjusted to correspond to the spaces between the terminal insertion channels 41 planed to receive the terminals 30.

The projection 122 enters the cutout 38 of the terminals, and the terminal supporting die 112*b* receives the terminals. The terminals are moved toward the terminal housing 40 by the actuator cylinder 113. Hence, the insertion unit 57 can insert reliably the terminals 30 required for one terminal housing 40 into the housing.

When the actuator cylinder 113 moves the terminal supporting die 112*b* toward the terminal housing 40, the abutting surface 119 of the pressing blade 117*b* abuts against the terminal 30. Thus, the terminals 30 are surely mounted in the terminal insertion channels 41.

Furthermore, the terminal transfer unit 57 moves the terminals 30 across the carrier cutting unit 54, the tab bending unit 55, the separator 57, and the insertion unit 57. Hence, the terminals 30 are surely inserted into the terminal housing 40, and a reduced time is required for inserting the terminals 30 into the terminal housing 40.

What is claimed is:

1. A terminal mounting method for mounting press-fit terminals (30) in a plurality of terminal insertion channels (41) parallel defined in an insulating housing (40), the method comprising:

a first step for adjusting spaces between adjacent ones of the terminals (30) such that each of the terminals can enter one of the terminal insertion channels (41), a second step for holding a required number of the terminals (30) for the insulating housing (40), a third step for inserting the terminals (30) all at once into the plurality of terminal insertion channels (41), wherein the terminal (30) has a connection portion (31) that can move into a connection state and an isolation state, the connection state connecting the terminal (30) to a second press-fit terminal (30) disposed in a second insulating housing (40) when the insulating housing having the terminal is layered on the second insulating housing, the isolation state isolating the terminal from the second press-fit terminal, and the method comprises a further step for moving the connection portion (31) to connect the terminal received in the insulating housing to the second press-fit terminal received on the second insulating housing and for keeping the connection portion to isolate the terminal received in the insulating housing from the second press-fit terminal when the insulating housings are layered.

2. The method set forth in claim 1, wherein the terminals (30) are supplied as a jointed terminal assembly having the parallel press-fit terminals and joint portions (39) jointing adjacent ones of the terminals to each other, and the method further comprises a further step for removing at least one of the joint portions (39) to isolate associated adjacent ones of the terminals from each other before the terminals are received in the insulating housing.

3. The method set forth in claim 1, wherein the insulating housing (40) can receive the terminals (30) in predetermined ones of the plurality of terminal insertion channels (41), and the method further comprises a further step for adjusting spaces between the terminals (30) held in the second step to coincide with spaces between the predetermined terminal insertion channels (41).

4. A terminal mounting method for mounting press-fit terminals (30) in a plurality of terminal insertion channels (41) parallel defined in an insulating housing (40), wherein the terminals are supplied as a jointed terminal assembly having the parallel press-fit terminals (30) and joint portions (39) jointed adjacent ones of the terminals to each other, and the terminal has a connection portion (31) that can move into a connection state and an isolation state, the connection state connecting the terminal to a second press-fit terminal (30) received in a second insulating housing (40) when the insulating housing having the terminal is layered on the second insulating housing, the isolation state isolating the terminal from the second press-fit terminal, the insulating housing (40) being able to receive the terminals (30) in predetermined ones of the plurality of terminal insertion channels (41), the method comprising:

a step S1 for adjusting spaces between adjacent ones of the terminals (30) such that each of the terminals can enter one of the terminal insertion channels (41), a step S2 for holding a required number of the terminals (30) for the insulating housing (40), and a step S3 for removing at least one of the joint portions (39) to isolate associated adjacent ones of the terminals from each other after the terminals have been received in the insulating housing, a step S5 for moving a connection portion (31) to a connection state and an isolation state, the connection state connecting the terminal to a second press-fit terminal received in a second insulating housing when the insulating housing having the terminal is layered on the second insulating housing, the isolation state isolating the terminal from the second press-fit terminal, a step S7 for adjusting spaces between the terminals (30) held in the second step to coincide with spaces between the predetermined terminal insertion channels (41), and a step S8 for inserting the terminals (30) all at once into a plurality of terminal insertion channels (41).

* * * * *